US010634451B1

(12) United States Patent
Thompson

(10) Patent No.: US 10,634,451 B1
(45) Date of Patent: Apr. 28, 2020

(54) SLING CLIPS AND ATTACHMENT

(71) Applicant: Stephen T. Thompson, Excelsior, MN (US)

(72) Inventor: Stephen T. Thompson, Excelsior, MN (US)

( * ) Notice: Subject to any disclaimer, the term of this patent is extended or adjusted under 35 U.S.C. 154(b) by 0 days.

(21) Appl. No.: 16/184,847

(22) Filed: Nov. 8, 2018

Related U.S. Application Data

(60) Provisional application No. 62/583,482, filed on Nov. 8, 2017.

(51) Int. Cl.
*F41C 33/00* (2006.01)

(52) U.S. Cl.
CPC ..... *F41C 33/001* (2013.01); *F41C 33/002* (2013.01)

(58) Field of Classification Search
CPC ..... F41C 23/02; F41C 33/00; F41C 33/001; F41C 33/002; F41C 33/006; F41C 33/007; F41C 33/008
USPC ..... 42/85; 224/150, 913
See application file for complete search history.

(56) References Cited

U.S. PATENT DOCUMENTS

| | | | |
|---|---|---|---|
| 163,195 | A | 5/1875 | Hester |
| 318,053 | A | 5/1885 | Thurlow |
| 618,216 | A | 1/1899 | Wolfe et al. |
| 828,321 | A | 8/1906 | Kimberly |
| 919,301 | A | 4/1909 | Anderson |
| 982,433 | A | 1/1911 | Knight et al. |
| 1,396,020 | A | 11/1921 | Buchsbaum |
| 1,446,058 | A | 2/1923 | Neilly |
| 1,602,893 | A | 10/1926 | Freysinger |
| 1,853,313 | A | 4/1932 | Mathis |
| 2,287,722 | A | 6/1942 | Beazley |
| 2,296,733 | A | 9/1942 | Paolino |
| 2,513,169 | A | 6/1950 | Griswold |
| 2,812,123 | A | 11/1957 | Girton |
| 2,820,498 | A | 1/1958 | Endee |
| 3,063,116 | A | 11/1962 | Mihalyi |
| 3,091,830 | A | 6/1963 | Harley |
| 3,098,591 | A | 7/1963 | Lerude |
| 3,191,826 | A | 6/1965 | Adams |

(Continued)

FOREIGN PATENT DOCUMENTS

| | | | |
|---|---|---|---|
| DE | 20119252 | U1 | 5/2002 |
| EP | 1530704 | B1 | 8/2011 |
| WO | WO 2004/001323 | A1 | 12/2003 |

OTHER PUBLICATIONS

Lee, Young-Shin; Choi, Young-Jin; Han, Kyu-Hyun; Chae, Je-Wook; Choi, Eui-Jung; and Kim, In-Woo; "A Study on the Human Impulse Characteristics of the Standing Shooting Postur"; Key Engineering Materials, vol. 297-300, p. 2314-2319 (2005).

*Primary Examiner* — Bret Hayes
(74) *Attorney, Agent, or Firm* — Albert W. Watkins

(57) ABSTRACT

A sling clip has a clamping mechanism capable of releasably securing a weapon strap when the strap is slidably received through an opening in the sling clip. The sling clip also has a let strap assembly configured to secure the sling clip proximate to a weapon bearer's body. The leg strap assembly incorporates Pouch Attachment Ladder System (PALS) compatible loops, a secondary belt fastener, and a pair of cantilevered arms that retain the sling clip. The clamping mechanism is operatively configured to secure the strap within the sling clip and thereby to the weapon bearer's body when the weapon is in a firing position and during firing.

9 Claims, 26 Drawing Sheets

(56) References Cited

U.S. PATENT DOCUMENTS

| | | | |
|---|---|---|---|
| 3,253,309 | A | 5/1966 | Baresch |
| 3,328,856 | A | 7/1967 | Joans |
| 3,344,486 | A | 10/1967 | Eveland |
| 3,413,691 | A | 12/1968 | Elsner |
| 3,608,158 | A | 9/1971 | Bengtsson |
| 3,648,332 | A | 3/1972 | Hauser |
| 3,655,106 | A | 4/1972 | Wojcinski |
| 3,927,808 | A | 12/1975 | Steen |
| 3,998,367 | A | 12/1976 | Harding |
| 4,331,271 | A | 5/1982 | Anderson |
| 4,373,234 | A | 2/1983 | Boden |
| 4,507,829 | A | 4/1985 | Looker |
| 4,541,149 | A | 9/1985 | Jensen |
| 4,567,628 | A | 2/1986 | Prete, Jr. et al. |
| 4,613,067 | A | 9/1986 | Gann |
| 4,726,625 | A | 2/1988 | Bougher |
| 4,727,628 | A | 3/1988 | Rudholm |
| 4,881,303 | A | 11/1989 | Martini |
| 4,942,647 | A | 7/1990 | Wallner |
| 5,050,786 | A | 9/1991 | DeMott |
| 5,074,011 | A | 12/1991 | Carlson |
| D327,455 | S | 6/1992 | Blair |
| 5,146,655 | A | 9/1992 | Gibbs |
| 5,205,021 | A | 4/1993 | Durand |
| 5,291,638 | A | 3/1994 | Huang |
| 5,325,618 | A | 7/1994 | Turner |
| 5,353,538 | A | 10/1994 | Hakedal et al. |
| 5,401,011 | A | 3/1995 | Gatenby et al. |
| 5,469,583 | A | 11/1995 | Akeley et al. |
| 5,615,811 | A | 4/1997 | Bell et al. |
| 5,661,877 | A | 9/1997 | Bloomer |
| 5,715,979 | A | 2/1998 | Crandall |
| 5,738,256 | A | 4/1998 | Goff et al. |
| 5,810,219 | A | 9/1998 | Rosenfield |
| 5,920,963 | A | 7/1999 | Chou |
| 5,988,466 | A | 11/1999 | Brown |
| 6,112,448 | A | 9/2000 | Gray et al. |
| 6,119,907 | A | 9/2000 | Benjamin |
| RE37,111 | E | 3/2001 | Barron |
| 6,260,748 | B1 | 7/2001 | Lindsey |
| 6,279,795 | B1 | 8/2001 | Pierzina |
| 6,543,096 | B2 | 4/2003 | Settelmayer et al. |
| 6,560,825 | B2 | 5/2003 | Maciejczyk |
| 6,665,913 | B2 | 12/2003 | Kosh et al. |
| 6,672,492 | B1 | 1/2004 | Thompson |
| 7,039,987 | B2 | 5/2006 | van Gijsel et al. |
| 7,051,407 | B2 | 5/2006 | Hsu |
| 7,121,122 | B2 | 10/2006 | Levi |
| 7,334,301 | B2 | 2/2008 | Huang |
| 7,444,720 | B2 | 11/2008 | Huang |
| 7,712,191 | B2 | 5/2010 | Huang |
| 7,950,551 | B2 | 5/2011 | Thompson |
| 8,857,680 | B1 | 10/2014 | Thompson |
| 2008/0217371 | A1* | 9/2008 | Wemmer ..... F41C 23/02 224/579 |
| 2010/0206921 | A1* | 8/2010 | Shen ..... F41C 33/002 224/150 |
| 2010/0300802 | A1* | 12/2010 | Kopp ..... A45F 3/14 182/3 |
| 2014/0367427 | A1* | 12/2014 | Bjelde ..... F41C 33/007 224/257 |
| 2017/0254616 | A1* | 9/2017 | Phillips ..... F41C 33/002 |

* cited by examiner

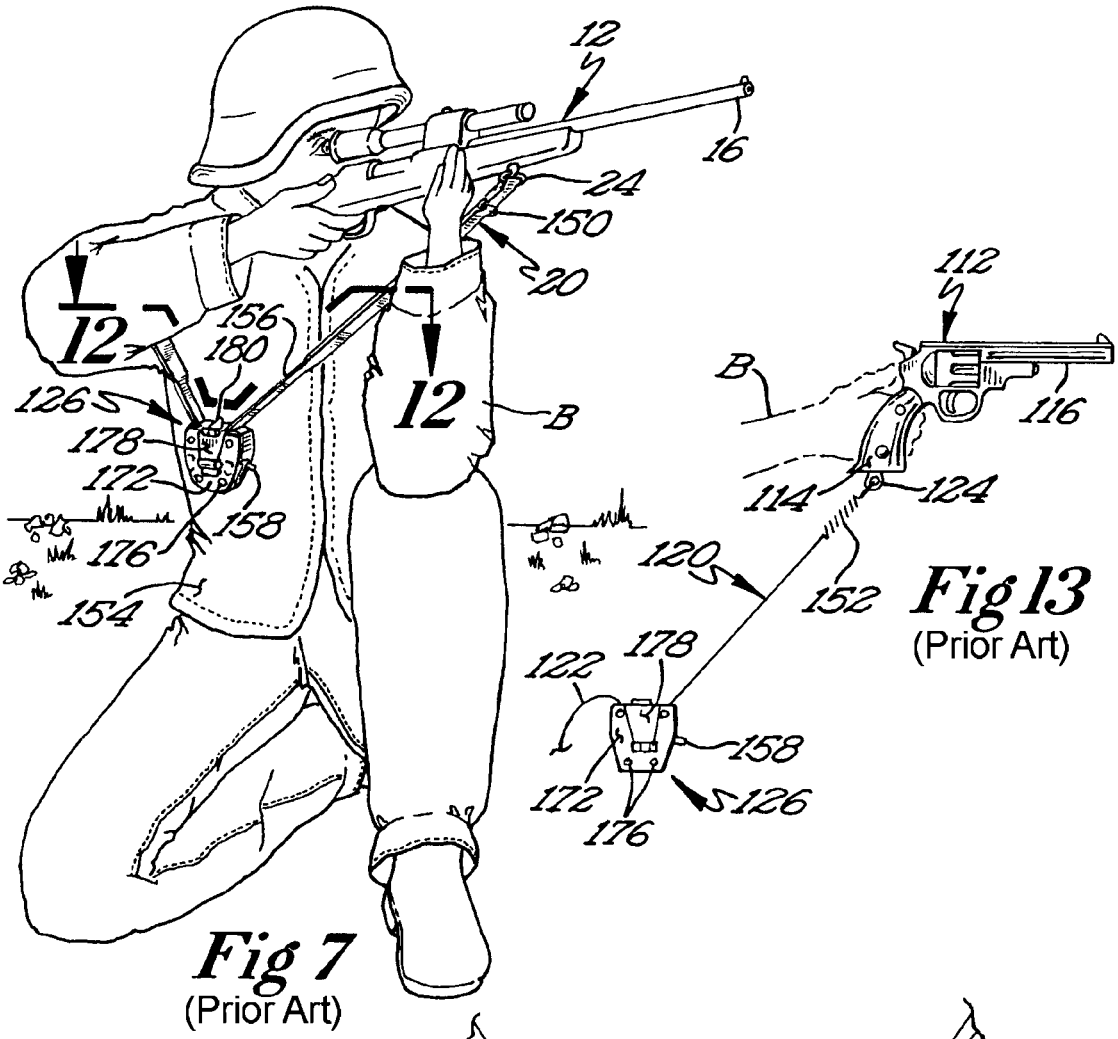
Fig 13
(Prior Art)
Fig 7
(Prior Art)
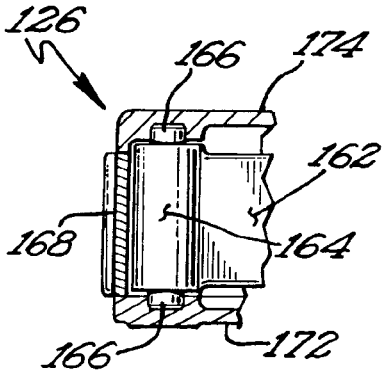
Fig 9
(Prior Art)
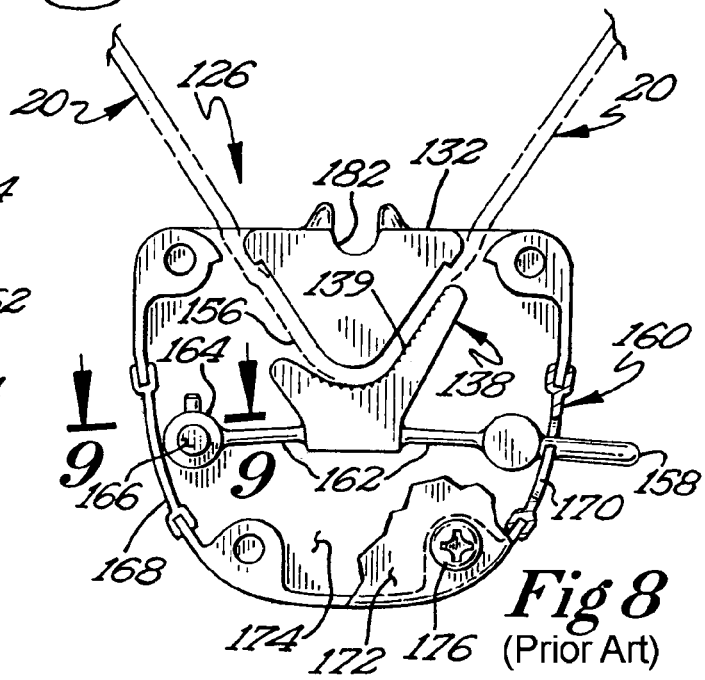
Fig 8
(Prior Art)

SLING CLIPS AND ATTACHMENT

CROSS REFERENCE TO RELATED APPLICATIONS

The present application claims the benefit of United States provisional patent application 62/583,482 filed Nov. 8, 2017 of like title and inventorship, the teachings and entire contents which are incorporated herein by reference.

BACKGROUND OF THE INVENTION

1. Field of the Invention

The present invention pertains generally to a sling for stabilizing weapons and other hand-held equipment during use and for transporting the same. In a more particular manifestation, the present invention pertains to a sling that couples the weapon to the user's body to steady the weapon.

2. Description of the Related Art

Shooting a weapon from a rest or standard shooting position can be very accurate and done at great range. This is because the standard shooting positions are selected to provide stability and predictability of movement during the firing of the projectile.

However, often times security forces must move with weapons to the shoulder in what is sometimes called a fluid situation. They may be advancing upon a target or avoiding danger. They must be able to fire while on the move which requires them to be able to acquire and hold sights upon the target while putting one foot in front of the other. This need to move and shoot is common in close combat and when tactically required due to terrain or other circumstance.

In contrast to shooting from a rest or standard position, moving and shooting results in lost accuracy and effective range. This results in the soldier having to be closer to the intended target and therefore in greater danger. Some of the tactics of when to fire are directly based upon the accuracy of firing while moving. As a result, a soldier may be forced into firing, knowing the erratic nature of the shots and instead counting on luck and proximity to the target.

Obstacles to accuracy produced by movement include increased area of muzzle wobble, speed of muzzle wobble, and a more erratic type of muzzle wobble, all which adversely affect trigger break, sight acquisition, and decision time. The machinations of the weapon from firing and moving combine to further decrease accuracy. Shot to shot recovery is also reduced.

Decreased accuracy caused by moving and shooting is directly due to the erratic motion of the front sight which is the key focal point of the soldier. The erratic front sight motion is caused by footfall and the need for improvised shooting positions.

The human skill set required to offset the problems of shooting and moving is very advanced. A skilled person would possess a high degree of athleticism and trigger control, but undesirably will still be slowed by movement. Even the best shooters fall well short of the steadiness and accuracy found in the standard standing, kneeling and prone shooting positions.

In recognition of the challenges of firing weapons, slings, straps, and the like are commonly used for transporting and stabilizing weapons and other hand-held equipment such as rifles, shotguns, handguns, bows, crossbows, binoculars, telescopes, and still and motion picture cameras. As used herein, the term weapon is intended to include rifles, shotguns, handguns, bows, crossbows and other like or related apparatus that fire projectiles.

One problem common to slings designed to facilitate the transportation of weapons is that there is little thought given to whether or how these slings may be used to stabilize the weapon during firing. One example is U.S. Pat. No. 3,098,591 to Lerude, the teachings which are incorporated herein by reference. Lerude's harness is adapted for carrying a rifle in a slung position but teaches nothing with regard to the stabilization of the weapon during firing. U.S. Pat. No. 4,613,067 to Gann, the teachings which are incorporated herein by reference, discloses a carrying sling that permits a weapon to be transported in a variety of positions but discloses no manner in which the carrying sling may be used to stabilize the gun during firing.

Other slings attempt to navigate the middle ground between ease of transportation and stabilization of the weapon for firing. Examples of such patents, the teachings which are incorporated herein by reference, include U.S. Pat. No. 4,331,271 to Anderson and U.S. Pat. No. 6,260,748 to Lindsey. Anderson discloses a sling for shoulder guns in which a shoulder gun is supported in a slung position from a belt to which is attached a strap. Pains are taken to insure that the shoulder gun will maintain its slung position during transport. However, for stabilization, Anderson relies on the well-known technique of wrapping the sling strap about the elbow of the arm with which the user of the weapon grasps the forearm of the stock. In this way, the user of the weapon is able to achieve a more secure connection between his or her arm and the weapon. However, this method of stabilizing a weapon for firing relies on the stability of the user's arms, an inherently unstable member of the human body. Accordingly, the Anderson sling is not capable of providing much in the way of stabilization for a weapon being fired.

The Lindsey sling is adapted for supporting a weapon across the front of the user's chest. A strap may be included between the muzzle end of the weapon and the shoulder of the user and by tensioning this strap between the shoulder and the muzzle end of the weapon the weapon may be stabilized to some degree. Not only is Lindsey's sling relatively limited insofar as it offers only two carrying positions for the weapon, but it provides no dissipation of the phenomenon of muzzle flip as the anchoring point for the stabilizing strap is positioned above the muzzle end of the weapon when the weapon is fired.

Other prior art designs have all but abandoned the goal of supporting a weapon for transport in favor of providing a maximum amount of stability for the weapon during firing. U.S. Pat. No. 5,738,256 to Goff et al., the teachings which are incorporated herein by reference, discloses an adaptable aiming support that essentially comprises a belt that has a rigid support with a fork at its upper end attached thereto. In use, the fork at the end of the rigid support is placed beneath the forearm or muzzle end of the weapon being fired when the weapon is in its firing position. The Goff et al aiming support does offer better stability to the weapon during firing but is incapable of use as a traditional sling in that it is not able to support a weapon during transport at all.

U.S. Pat. No. 5,988,466 to Brown, the teachings which are incorporated herein by reference, is a variation upon the adaptable aiming support of Goff et al. in that the tubular support member upon which a weapon is supported is permanently affixed to the weapon and is constructed and arranged to have a greater degree of rotation, thereby allowing the gun to be moved from a firing position to a carrying position in which the muzzle of the gun points upwardly. However, the weapon remains coupled to the tubular support member and may not be transported apart from the support without first uncoupling the weapon from the support. But in doing so, the weapon will have to be re-coupled to the support for use in the intended manner.

U.S. Pat. No. 6,112,448 to Gray et al., the teachings which are incorporated herein by reference, discloses a forearm sling that attempts to improve the stability of a weapon during firing by coupling the weapon to the forearm of the user. Again, while coupling a weapon to the arm of a user can increase the stability of the weapon during firing to some degree, the arm of a user is inherently unstable and cannot adequately stabilize a weapon during firing. What is more, the Gray et al. forearm sling has no way of counteracting the incidence of muzzle flip engendered by the firing of the weapon and does not provide a means for transporting the weapon.

Additional exemplary U.S. patents pertaining to slings, the teachings which are incorporated herein by reference, include: U.S. Pat. No. 919,301 by Anderson, entitled "Gun carrier"; U.S. Pat. No. 1,446,058 by Neilly, entitled "Clasp"; U.S. Pat. No. 2,812,123 by Girton, entitled "Multipurpose gun sling"; U.S. Pat. No. 2,820,498 by Endee, entitled "Golf bags"; U.S. Pat. No. 3,191,826 by Adams, entitled "Gun rest"; U.S. Pat. No. 3,655,106 by Wojcinski, entitled "Gun-belt"; U.S. Pat. No. 3,927,808 by Steen, entitled "Device for firearm"; U.S. Pat. No. 3,998,367 by Harding, entitled "Shoulder harness for carrying an archery bow"; U.S. Pat. No. 5,325,618 by Turner, entitled "Safety device for a rifle"; U.S. Pat. No. 5,353,538 by Hakedal et al, entitled "Rifle sling"; U.S. Pat. No. 5,615,811 by Bell et al, entitled "Retractable carrying device"; U.S. Pat. No. 5,715,979 by Crandall, entitled "No-pulse rifle sling"; U.S. Pat. No. 5,810,219 by Rosenfield, entitled "Gun sling"; U.S. Pat. No. 6,119,907 by Benjamin, entitled "Shoulderarm gun case convertible to belt pack"; U.S. Pat. No. 6,279,795 by Pierzina, entitled "Shoulder strap"; and Re 37,111 by Barron, entitled "Rifle sling support apparatus". A further German patent pertaining to slings, the teachings which are incorporated herein by reference, is DE 20119252U1 by Wehner, entitled "Safety device for handguns".

Additional U.S. patents that illustrate a variety of strap and belt clamps, buckles, and the like, the teachings which are incorporated herein by reference, include: U.S. Pat. No. 163,195 by Hester, entitled "Buckle"; U.S. Pat. No. 318,053 by Thurlow, entitled "Lever buckle"; U.S. Pat. No. 618,216 by Wolfe et al, entitled "Skirt lifter and supporter"; U.S. Pat. No. 828,321 by Kimberly, entitled "Hame tie fastener for harness and holdback straps"; U.S. Pat. No. 982,433 by Knight et al, entitled "Self locking buckle"; U.S. Pat. No. 1,396,020 by Buchsbaum, entitled "Belt buckle"; U.S. Pat. No. 1,602,893 by Freysinger, entitled "Belt buckle"; U.S. Pat. No. 1,853,313 by Mathis, entitled "Line grip"; U.S. Pat. No. 2,287,722 by Beazley, entitled "Buckle"; U.S. Pat. No. 2,296,733 by Paolino, entitled "Gun sling"; U.S. Pat. No. 2,513,169 by Griswold, entitled "Safety belt buckle"; U.S. Pat. No. 3,063,116 by Mihalyi, entitled "Buckle structure"; U.S. Pat. No. 3,091,830 by Harley, entitled "Buckles"; U.S. Pat. No. 3,253,309 by Baresch, entitled "Buckle assembly"; U.S. Pat. No. 3,328,856 by Jonas, entitled "Adjustable strap buckle"; U.S. Pat. No. 3,344,486 by Eveland, entitled "Buckle having a pressure member connected to slotted pivotally related frame members"; U.S. Pat. No. 3,413,691 by Elsner, entitled "Buckle"; U.S. Pat. No. 3,608,158 by Bengtsson, entitled "Buckle"; U.S. Pat. No. 3,648,332 by Hauser, entitled "Slip-through buckle for watchband"; U.S. Pat. No. 4,373,234 by Boden, entitled "Device for gripping an elongated flexible element"; U.S. Pat. No. 4,507,829 by Looker, entitled "Light weight tensionable buckle"; U.S. Pat. No. 4,541,149 by Jensen, entitled "Device for selectively locking and releasing a rope member extending therethrough"; U.S. Pat. No. 4,567,628 by Prete, Jr. et al, entitled "Cam buckle assembly for use in tying down loads"; U.S. Pat. No. 4,726,625 by Bougher, entitled "Belt retraction cam lock"; U.S. Pat. No. 4,727,628 by Rudholm, entitled "Strap buckle with self-locking function"; U.S. Pat. No. 4,881,303 by Martini, entitled "Quickly adjustable stirrup buckle"; U.S. Pat. No. 4,942,647 by Wallner, entitled "Tensioning buckle"; U.S. Pat. No. 5,050,786 by DeMott, entitled "Waist-attached cable holder"; U.S. Pat. No. 5,074,011 by Carlson, entitled "Strap lock for adjusting loops"; U.S. Pat. No. 5,146,655 by Gibbs, entitled "Safety clamp appliance"; U.S. Pat. No. 5,205,021 by Durand, entitled "Quick release buckle assembly"; U.S. Pat. No. 5,291,638 by Huang, entitled "Tightening up device"; U.S. Pat. No. 5,401,011 by Gatenby et al, entitled "Belt clamp"; U.S. Pat. No. 5,469,583 by Akeley et al, entitled "Strap lock buckle"; U.S. Pat. No. 5,661,877 by Bloomer, entitled "Belt or webbing buckle having plural independently operable securement and release mechanisms"; U.S. Pat. No. 5,920,963 by Chou, entitled "Rope fastener"; U.S. Pat. No. 6,543,096 by Settelmayer et al, entitled "Load carrier system"; U.S. Pat. No. 6,560,825 by Maciejczyk, entitled "Webbing length adjustor"; U.S. Pat. No. 6,665,913 by Kosh et al, entitled "End-fitting webbing buckle"; U.S. Pat. No. 7,039,987 by van Gijsel et al, entitled "Suspension system"; U.S. Pat. No. 7,051,407 by Hsu, entitled "Brassiere strap clasp"; U.S. Pat. No. 7,121,122 by Levi, entitled "Strap lock"; U.S. Pat. No. 7,334,301 by Huang, entitled "Buckle"; U.S. Pat. No. 7,444,720 by Huang, entitled "Buckle"; U.S. Pat. No. 7,712,191 by Huang, entitled "Secure fastener for belts"; and U.S. Pat. No. Des 327,455 by Blair, entitled "Buckle".

My prior U.S. Pat. Nos. 6,672,492; 7,950,551, and 8,857,680 each provide improvement over the aforementioned prior art by providing a sling that anchors at both ends of a weapon, and to a solid anchor point on the body of the person. The body anchor point may for exemplary purpose be proximate to the chest, the back, the hips or other relatively stable portion of a user's body, so long as the anchor point is sufficiently stable to also help steady the weapon during firing. My slings are configured for use with weapons of various types and with other types of hand-held equipment, and can facilitate the transport of the weapon in a variety of slung positions, in the crook of an arm, or in the hands, that does not involve the need to disassemble the sling. There is also a need for a sling that can couple a weapon to the user's body (e.g., proximate, the chest, the back, the hips or other truncal portion of a user's body) to sufficiently stabilize the weapon for firing. Such a sling should be usable in multiple shooting/use positions.

While the sling illustrated in my prior U.S. Pat. Nos. 6,672,492; 7,950,551 and 8,857,680 provide substantial benefit over the prior art slings, straps, and other apparatus, there remains a need for an apparatus that provides even further improvement in reducing the effects of wobble, recoil, and body movement. This will most preferably be provided for both stationary and mobile shooting, including rapid or automatic firing sequences. In addition, there remains a need for such a sling that is selectively coupled to a suitable body anchor point quickly and effectively, and which is durable resistant to contamination in the field.

The foregoing patents are incorporated herein by reference for the relevant content and teachings contained therein. In addition, Webster's New Universal Unabridged Dictionary, Second Edition copyright 1983, is incorporated herein by reference in entirety for the definitions of words and terms used herein.

SUMMARY OF THE INVENTION

A sling clip is disclosed that has a clamping mechanism capable of releasably securing the strap when the strap is slidably received through an opening in the sling clip. The sling clip also has an attachment apparatus configured to secure the sling clip proximate to a weapon user's body. The clamping mechanism is operatively configured to secure the strap within the sling clip when the weapon is in a firing position such that the strap minimizes movement of a muzzle end and a butt end of the weapon caused by recoil of the weapon upon firing. The strap also allows the user to rapidly raise the weapon to firing or use position, and minimizes or eliminates the need for antagonistic muscle action to achieve the desired firing position. A weapon sling including the sling clip also is disclosed.

In a first manifestation, the invention is a weapon sling adapted to operatively support a rifle upon a bearer. A flexible strap has a first end and a second end. The first strap end is secured to the rifle near the muzzle, while the second strap end is secured near the rifle butt. A sling clip is engaged with the flexible strap and is adapted to operatively permit the rifle bearer to move the rifle from a slung position to a firing position without disconnecting the flexible strap from the sling clip. A shaft protrudes from the sling clip. A disk terminates the shaft distal to the sling clip and has a diameter greater than the protruding shaft. A leg strap assembly is configured to operatively secure to the rifle bearer. A weapon sling clip coupler is secured to the leg strap assembly, and has a pair of cantilevered arms defining a gap therebetween that are configured to receive and retain the protruding shaft, and thereby couple the flexible strap through sling clip and protruding shaft to the leg strap assembly.

In a second manifestation, the invention is a weapon sling adapted to operatively provide additional support for a weapon carried by a weapon bearer. A strap has a first end and a second end. The first strap end is secured to the weapon distal to a second strap end securement. A sling clip is engaged with the strap and is adapted to operatively permit the weapon bearer to move the weapon from a slung position to a firing position without disconnecting the strap from the sling clip. A leg strap assembly is configured to operatively secure to the weapon bearer. A weapon sling clip coupler has a spring resiliently securing the sling clip to the leg strap assembly.

In a third manifestation, the invention is a weapon sling system. The weapon sling system includes a flexible strap and a sling clip. The flexible strap has first and second end portions, the first end portion configured to be secured to a weapon at a butt end of the weapon and the second end portion of the strap configured to be secured to the weapon adjacent a muzzle end of the weapon distal to the butt end. The sling clip is configured to be secured proximate a weapon bearer's body, and is operatively configured to secure the strap within the sling clip when the weapon is in a firing position and the lock cam handle is pivoted to the locking position to reduce movement of a muzzle end of the weapon when firing. The sling clip has a strap guide defining first and second sidewalls, a bottom, and a pair of strap inlet/outlets; a pair of transversely oriented bottom guides adjacent to the bottom; a lock cam pivot shaft extending between the first and second sidewalls transverse to the strap guide; and a lock cam having a lock cam handle pivotal about the lock cam pivot shaft between an unlocked position and a locking position, and first and second cams simultaneously operated by the lock cam handle, the first cam adjacent to the first sidewall and distal to the second sidewall, and the second cam adjacent to the second sidewall and distal to the first sidewall. The first and second cams are configured when the flexible strap is slidably received in the strap guide and the lock cam handle is pivoted to the locking position to deflect the flexible strap into a space between the pair of transversely oriented bottom guides and toward the strap guide bottom and thereby releasably secure the flexible strap within the lock cam.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 7 illustrates a user of a rifle having another embodiment of a sling coupled thereto with the user holding the rifle in a kneeling firing position.

FIG. 8 illustrates still another embodiment comprising a sling clip having a clamping mechanism.

FIG. 9 is a close-up view of the bearing assembly taken along a section line of the clamping mechanism shown in FIG. 8.

FIG. 13 illustrates yet another alternative embodiment weapon sling with a sling clip attached at a single point to a handgun.

DESCRIPTION OF THE PREFERRED AND ALTERNATIVE EMBODIMENTS

Figures 1, 4, 5, 6:
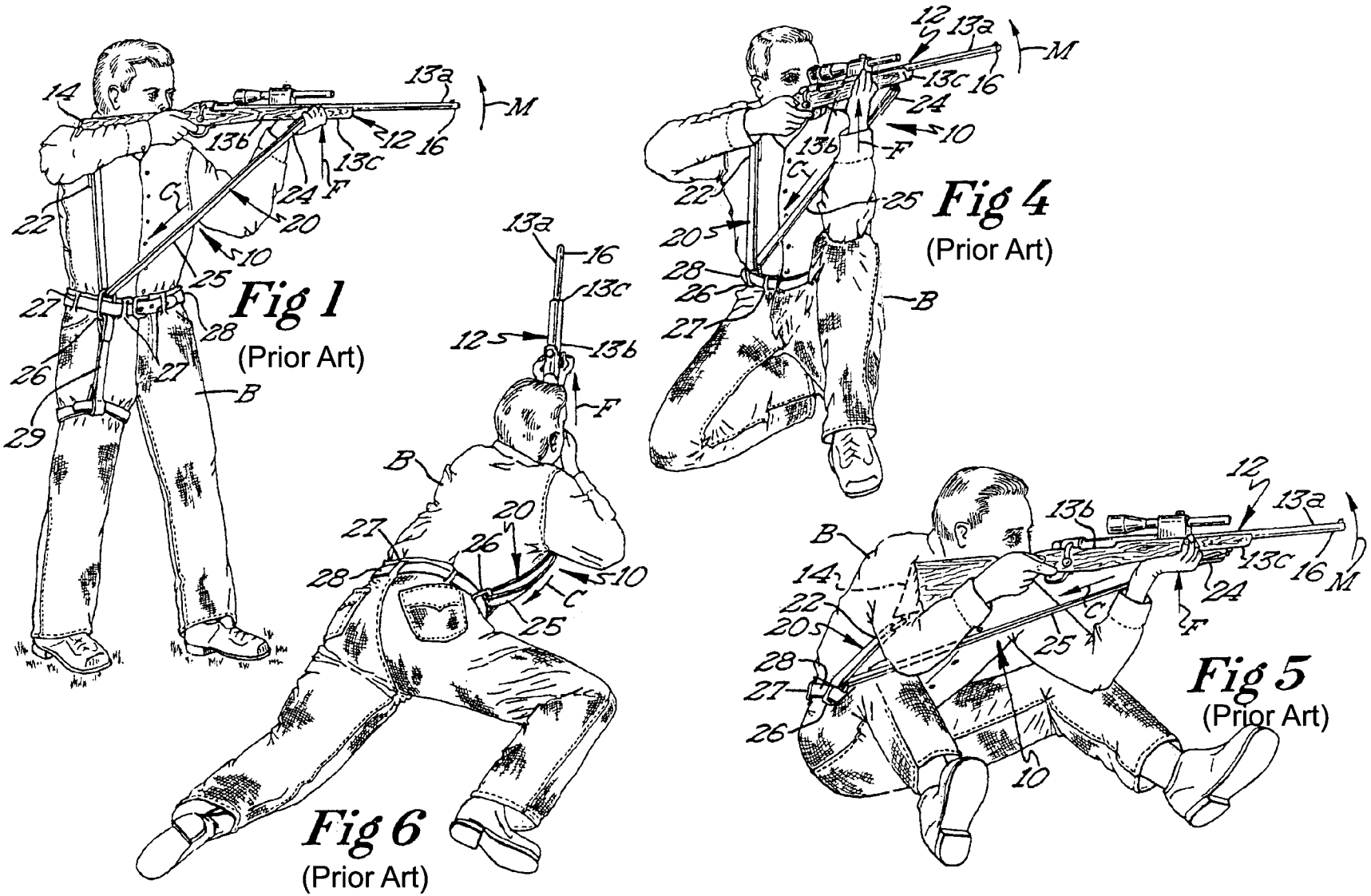
Fig 1 (Prior Art)
Fig 4 (Prior Art)
Fig 5 (Prior Art)
Fig 6 (Prior Art)
FIG. 1 illustrates a user of a rifle holding the weapon in a standing, offhand firing position with an embodiment of the rifle sling being deployed in firing position.
FIG. 4 illustrates a user of a rifle having a sling coupled thereto with the user holding the rifle in a kneeling firing position.
FIG. 5 illustrates a user of a rifle having a sling coupled thereto with the user holding the rifle in an open-legged sitting firing position.
FIG. 6 illustrates a user of a rifle having a sling coupled thereto with the user holding the rifle in the Olympic prone firing position.

According to various embodiments of the invention, a sling arrangement may provide improved stability for a weapon, for exemplary and non-limiting purposes such as a typical rifle or shotgun. When the sling arrangement is employed in connection with a rifle, the rifle has a barrel mounted in a stock with a butt end arranged to be positioned against the shoulder of a user when the rifle is in a firing position and a forearm portion positioned adjacent a muzzle end of the barrel, with the muzzle end of the rifle being supported at the forearm portion of the stock by the user when the rifle is in its firing position. The rifle is steadied in its firing position by a sling that comprises a flexible strap that has a first end and a second end. The first end of the strap is pivotally attached to the rifle adjacent its butt end, the second end of the strap being similarly attached to the rifle at the forearm portion of the stock of the rifle adjacent the muzzle end of the barrel of the rifle. Typically, the strap of the sling is attached to the rifle using standard, well-known devices such as a simple D-ring screwed to the stock of the rifle or a hammerhead sling socket. The strap also has an intermediate portion that is coupled proximate to a body portion of the user of the rifle (e.g., waist, side, chest, or back).

When the rifle is in its firing position with the butt end of the rifle positioned against the user's shoulder, the strap of the sling extends downward to a clamp or tether anchored adjacent the user's waist, hip or leg, and from there to the forearm portion of the stock of the rifle, thereby creating a relatively rigid coupling between the waist or torso of the user and the rifle. This coupling between the muzzle end of the rifle and the waist of the user counters recoil forces engendered in the rifle as a result of firing the rifle from causing to the muzzle end of the rifle to rise. This rise, called muzzle flip, can negatively affect the aim of the user and result in inaccurate and imprecise shooting. Rapid fire weapons, such as squad automatic weapons (SAWs), exhibit a particularly strong tendency for muzzle rise. The coupling between the butt end of the rifle and the clamp counters the tendency of the shooter to twist in their torso, referred to as truncal twist, while also countering the tendency of the shooter's shoulders to be driven backward which would otherwise also lead to muzzle flip.

A feature of an embodiment of the sling is that the strap of the sling is also capable of supporting the rifle in a carrying position in which the rifle is positioned on the back of the user for transport.

The strap of the sling may be coupled to the waist or torso of the user of the rifle in many ways. In some embodiments, the sling strap 20 is simply passed through the belt 28 or a belt loop 27 of the user. Because the butt end of the rifle stock is firmly anchored to the shoulder area of the torso, the fixed length of the strap effectively couples the muzzle end of the rifle to the waist of the user so as to prevent or at least reduce muzzle flip.

Figures 2, 3:
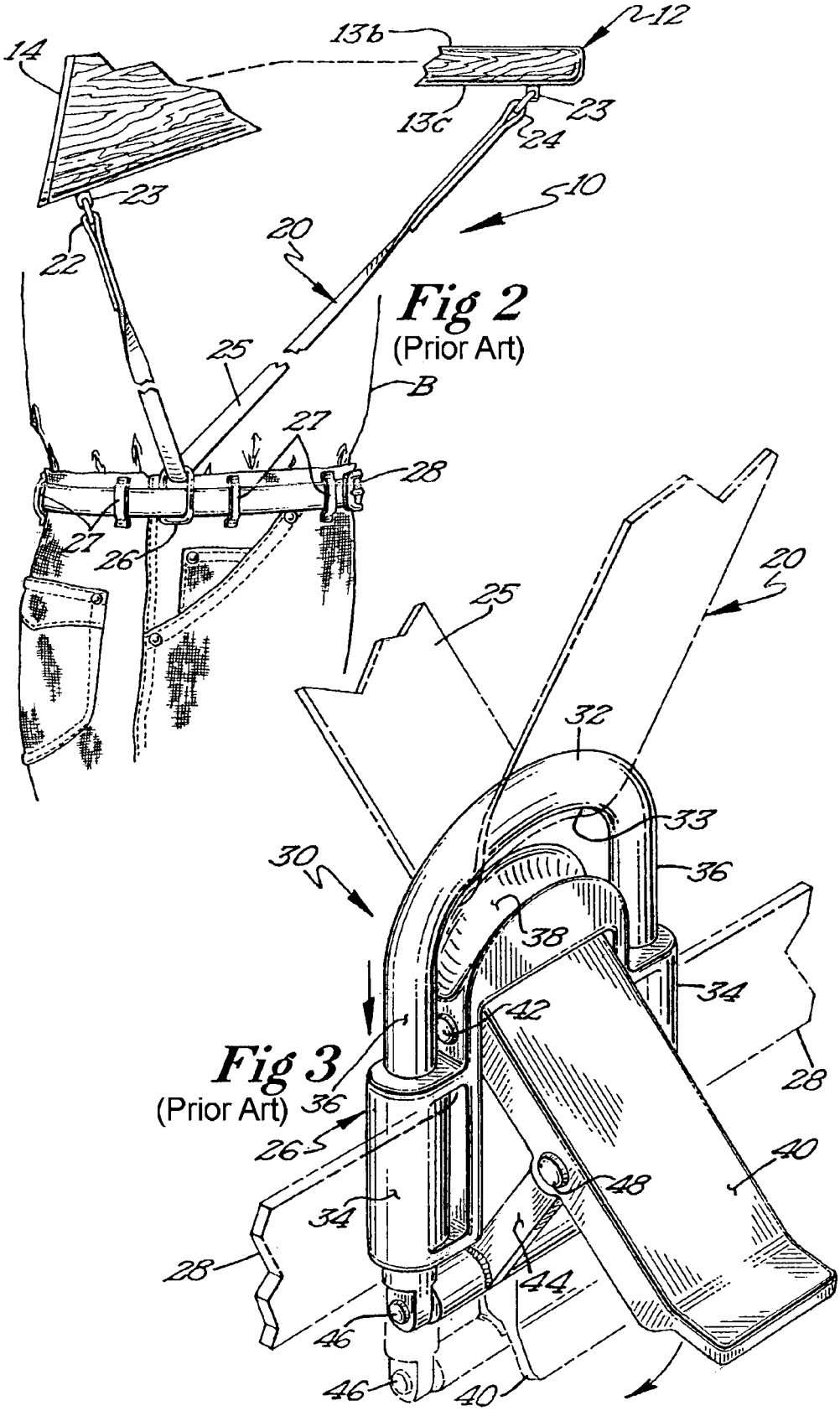
Fig 2 (Prior Art)
Fig 3 (Prior Art)
FIG. 2 is a close-up of an embodiment comprising a simple carabiner coupled to a belt passed around the waist of the user.
FIG. 3 is a close-up of an embodiment comprising a sling clip having a clamping mechanism.

In another embodiment as shown in FIG. 2, the strap 20 of the rifle sling 10 is coupled to the waist of the user using a simple carabiner type mechanism 26 that is itself coupled to the belt 28 or belt loop 27 of the user. Use of the carabiner allows the sling strap to be easily detached from the waist of the user. Alternatively, the user may couple the sling strap to his or her waist using a more complex harness that attaches to the waist and/or at least one leg of the user.

Where desirable, the sling strap may be constrained with respect to the user's waist and to the carabiner type structure used to couple the sling strap thereto. A simple way of accomplishing this is to secure a stop to the sling strap so as to control the movement of the sling strap through the carabiner or loop that couples the sling strap to the user's waist. The stop creates a relatively rigid connection of predetermined length between the muzzle end of the rifle and the waist of the user by limiting the travel of the sling strap through the carabiner or ring coupled to the waist of the user. In another embodiment, a sling clip is coupled to the waist of the user and is constructed and arranged to releasably grip the strap of the sling when the rifle is in its firing position. Once the rifle is in its firing position, the sling clip grasps the strap and securely couples the muzzle end of the rifle to the waist of the user to prevent or limit muzzle flip.

In some embodiments, the sling strap is substantially non-elastic or has an elasticity that is relatively low. Good examples of suitable materials from which the sling strap may be fashioned include webbing of nylon and other synthetic materials such as Kevlar, polyvinyl chloride, and the like and natural materials such as leather. In other embodiments, however, the sling strap is substantially elastic or has a relatively high elasticity, or includes a relatively elastic section. Such embodiments may benefit from improved shock absorption, as well as a reduced need to adjust the length of the sling strap for different applications or users.

In certain embodiments of the sling, the flexible strap and the sling clip permit the user of the rifle to carry the rifle in the port arms position, cradled in the crook of the user's right or left arm, cantilevered over the user's right or left forearm with the stock of the rifle being wedged under the user's respective arm, to be slung over the shoulder of the user, to be slung across the user's back, and to be carried in the hand of the user with the user's arm extended, respectively. Similarly, the rifle may be fired from a group of firing positions including, but not limited to, a prone position, a sitting position, a squatting position, an offhand position, a standing position, a kneeling position, and a rest position in which the rifle is supported, at least in part, by an object other than the user of the rifle. The rifle may be freely moved between the transport or carrying positions and the firing position with ease and without requiring the sling strap to be uncoupled from the hips of the user.

FIG. 1 illustrates a rifle sling 10 according to one embodiment as it is employed with a firearm, such as a rifle 12. The rifle 12 is of a known configuration, having a tubular barrel 13*a* mounted on a stock 13*b*. The stock 13*b* has a forward portion known as the forearm 13*c* that is generally positioned under the barrel 13*a* of the rifle 12 near a muzzle end 16 of the rifle. The forearm 13*c* of the rifle 12 may be separated from the remainder of the stock 13*b* or may be formed integrally therewith. As can be seen, the bearer B of the rifle 12 has placed the rifle 12 in a firing position in which a butt end 14 of the rifle 12 is seated firmly into the shoulder of the bearer B with the rifle 12 held generally horizontal and supported by the bearer B at the forearm 13*c* near the muzzle end 16 of the rifle 12.

The sling 10 includes a strap 20 that is secured at a first end portion 22 near the butt end 14 of the rifle 12 and at a second end portion 24 near the muzzle end 16 of the rifle 12. See FIG. 2. Note that the exact manner in which the respective end portions 22, 24 of the strap 20 are secured to the rifle 12 may vary. For example, the strap 20 may be secured at its end portions 22, 24 to the rifle 12 by means of a swivel 23 of a type commonly known to the prior art for attaching rifle slings to a rifle 12. The strap 20 is fashioned of a flexible material such as leather or nylon webbing and may also include an adjustment mechanism for modifying the length of the strap (not shown). Such adjustment mechanisms are commonly known in the prior art.

The strap 20, along with any adjustment mechanisms and the mechanisms whereby the strap end portions 22, 24 are secured to the rifle 12 may be either inelastic or elastic. Flexibility of the strap 20 facilitates firing and transporting the rifle 12. An inelastic strap 20 maintains substantially the same length at all times after its initial configuration. While it is appreciated that the certain materials from which the strap may be made, such as leather and nylon webbing, do incorporate some degree of flexibility, this inherent flexibility would not substantially affect the overall elasticity of the strap 20. Reducing the flexibility of the strap 20 facilitates maintaining substantially the same length at all times after initial configuration of the strap 20. In applications in which this characteristic is desirable, it may be preferable to utilize a substantially inelastic material such as Kevlar™, carbon fiber composites, or the like. In other embodiments, the strap 20 is made of a relatively elastic material. Such embodiments may benefit from improved shock absorption, as well as a reduced need to adjust the length of the sling strap for different applications or users. In still other embodiments, the strap 20 may include portions that are relatively inelastic and other portions that are relatively elastic. In addition to material considerations, the relative dimensions of the material will also affect elasticity, so for exemplary purposes it is further contemplated herein that a material such as Kevlar™ might be used, and the strap designed with wider or thicker sections that are thereby rendered substantially inelastic for typical forces, and thinner or narrower sections that are thereby rendered relatively elastic for typical forces during use.

A portion 25 of the strap 20 intermediate the end portions 22, 24 is passed through a sling clip 26. The sling clip is in turn coupled to the waist or truncal portions of the bearer B. In the embodiment illustrated in FIG. 1, when a rifle 12 is to be fired, the butt end 14 of the rifle will be firmly pressed into the shoulder of the bearer B. The placement of the butt end 14 of the rifle 12 in the shoulder essentially fixes the position of the first end 22 of the strap 20 with regard to the waist and truncal portions of the bearer B. The intermediate portion 25 of the strap 20 is similarly anchored to the waist and truncal portions of the bearer's body by means of the sling clip 26. The sling clip 26 may be as simple as a belt loop 27 on the bearer's B trousers or a carabiner of the type commonly used by climbers. More complex sling clips 26 may also be used. Note that the sling clip 26 may be coupled to the bearer's waist by means of a belt loop 27 or a belt 28. The belt 28 may be used on its own or may be combined with or may form part of a harness 29. In some embodiments, the harness 29 further couples the sling clip 26 to the legs of the bearer B similar to the manner in which a typical climbing harness is secured to both the waist and legs of a climber.

The secure placement of the butt end 14 of the rifle 12 into the shoulder of the bearer B, along with the secure coupling of the intermediate portion 25 of the strap 20 to the waist of the bearer B effectively couples the muzzle end 16 of the rifle 12 to the waist and truncal portions of the bearer B. The application of a light to moderate upward force against the forearm 13*c* of the rifle by the forward hand of the bearer B, indicated by arrow F, serves to complete the coupling of the muzzle 16 of the rifle 12 to the truncal portions of the bearer B by creating a relatively rigid structural member having a triangular shape with apexes at the first and second end portions 22, 24 of the strap 20 and at the intermediate portion 25 of the strap 20 where it passes through the sling clip 26.

When the rifle 12 is fired, the recoil engendered by the firing tends to create a moment indicated by arrow M that is commonly referred to as muzzle flip. In rifles, shotguns, or other weapons constructed and arranged for a high rate of fire such as with semi-automatic and fully automatic weapons, the additive effect of multiple applications of the moment M can result in severe accuracy problems in that the muzzle end 16 of the rifle 12 will be jerked out of alignment with an intended target (not shown). The sling 10 of FIG. 1 counteracts the moment M by applying a counteracting corrective force indicated by arrow C to the muzzle end 16 of the rifle 12 through the second end 24 of the strap 20. Because the rifle 12, the truncal portion of the bearer's body between the shoulder and the waist, and the strap 20 maintain essentially the same dimensions at all times during the firing of the rifle 12, the moment M engendered by the recoil in the rifle 12 will be counteracted by a tension in the strap 20 indicated by arrow C. Note that the rifle 12 may be fired in many different positions while using the sling 10. By way of example and not limitation, a rifle 12 incorporating the sling 10 may be fired from an offhand standing position as seen in FIG. 1, from a kneeling position as seen in FIG. 4, from an open-legged position as seen in FIG. 5, and from the Olympic prone position as seen in FIG. 6. Note that sling 10 may be employed from virtually any firing position, including, but not limited to, standing positions, sitting positions, prone positions, kneeling positions, and bench rest positions.

Because the intermediate portion 25 of the strap 20 may freely pass through sling clip 26 illustrated in FIG. 1, it is relatively simple to move rifle 12 from its firing position illustrated in FIG. 1 to a slung position (not shown) in which the rifle is positioned over the right shoulder with the muzzle end 16 of rifle 12 pointing upwards over the bearer's shoulder; the strap 20 passes over the shoulder to support rifle 12. Rifle 12 may also be transported slung diagonally across the bearer's back, in the hand with the carrying arm extended, cradled in the crook of the bearer's right or left arm with the muzzle end 16 of rifle 12 pointing upward, in a port arms or ready position, or cantilevered over the right or left forearm of the bearer B with the butt end 14 of rifle 12 wedged beneath the corresponding right or left arm. Each of these transport positions for rifle 12 may be achieved without first uncoupling strap 20 from the waist and truncal regions of the bearer B.

FIG. 3 illustrates an embodiment including a sling clip 26 that incorporates a clamping or locking mechanism 30. The sling clip 26 comprises a U-shaped ring 32 and a sliding block 34 received onto parallel legs 36 of ring 32. The sliding block 34 slides on legs 36 between the open position shown in FIG. 3 and a closed position. In the closed position, an upper, curved portion 38 of the sliding block engages a bottom portion 33 of ring 32 and consequently clamps strap 20 therebetween and controls the movement of strap 20 through sling clip 26. In FIG. 3, strap 20 of sling 10 is shown in phantom. The sliding block 34 is actuated between its open and closed positions by locking mechanism 30.

Locking mechanism 30 comprises an over-center lever mechanism having a lever arm 40 that is pivotally pinned to the sliding block by a pin 42. One or more fulcrum arms 44 are pivotally pinned to the distal ends of legs 36 of by a pin 46. The fulcrum arms 44 are pivotally pinned at their opposing ends to an intermediate portion of the lever arm 40 by pins 48. When the lever arm 40 is moved from its open position to its closed position as shown in phantom in FIG. 3, the pinned end of the lever arm acts in conjunction with the fulcrum arms 44 to move the sliding block 34 to its closed position (not shown). The locking mechanism 30 may be operated by the bearer B by simply pressing down the lever arm 40 with the trigger hand when the rifle 12 is in its desired firing position. Preferably, the locking mechanism 30 will be constructed and arranged to remain in its closed position until such time as the bearer B physically opens or actuates the lever arm 40. This is easily accomplished by forming the lever arm 40 and the fulcrum arms 44 in an over-center arrangement. The sling clip 26 may be coupled to the hips of the bearer 26 by providing an attachment mechanism that may be coupled to a belt 28 or harness 29 that are themselves coupled to the bearer B.

FIGS. 7 through 12 illustrate a bearer of a rifle having an alternative embodiment sling that is similar to the preferred embodiment depicted in FIGS. 1 through 6. In this alternative embodiment, as more clearly shown in FIG. 7, a bearer B of a rifle or other weapon has an alternative embodiment sling clip 126 coupled proximate to a side or chest portion of the bearer's body B. It will be appreciated by those skilled in the art that the sling clip 126 could be attached to various parts of the bearer's body without departing from the scope and spirit of the present invention (e.g., proximate a thigh, arm, back, chest, side, or waist portion of the body). The spring clip 126 can be securely attached by any of a variety of attachment mechanisms (not shown) such as a bolt, rivet, screw, button hole, leather loop, or the like that to clothing or body armor 154 on the bearer B so that the spring clip 126 is secured proximate to the weapon bearer's body B. The bearer B is holding the rifle 12 in a kneeling firing position. Preferably, the anchor point to which spring clip 126 is secured will be a solid anchor point for a given shooting position. This means that, if anchored to body armor, the body armor must in turn be securely anchored to the bearer's body, and not be able to move freely with respect thereto.

The second end 24 of the strap 20 shown in FIG. 7 also has an elastic member 150 located near the muzzle end 16 of the rifle 12. This elastic member 150 helps to dampen vertical movement of the muzzle end 16 caused by recoil motion of the rifle when the rifle is fired. This dampening action of the elastic member 150 is especially helpful on semi-automatic firearms that may have recoil motion when fired in rapid succession by supplementing the counteracting corrective force indicated by arrow C that is already being applied by sling 10. The elastic member 150 may be an elastic strap, rubberized link, a metal or plastic spring or any other device that tends to dampen movement of elements that are attached to opposite ends of the elastic member.

Figure 11:
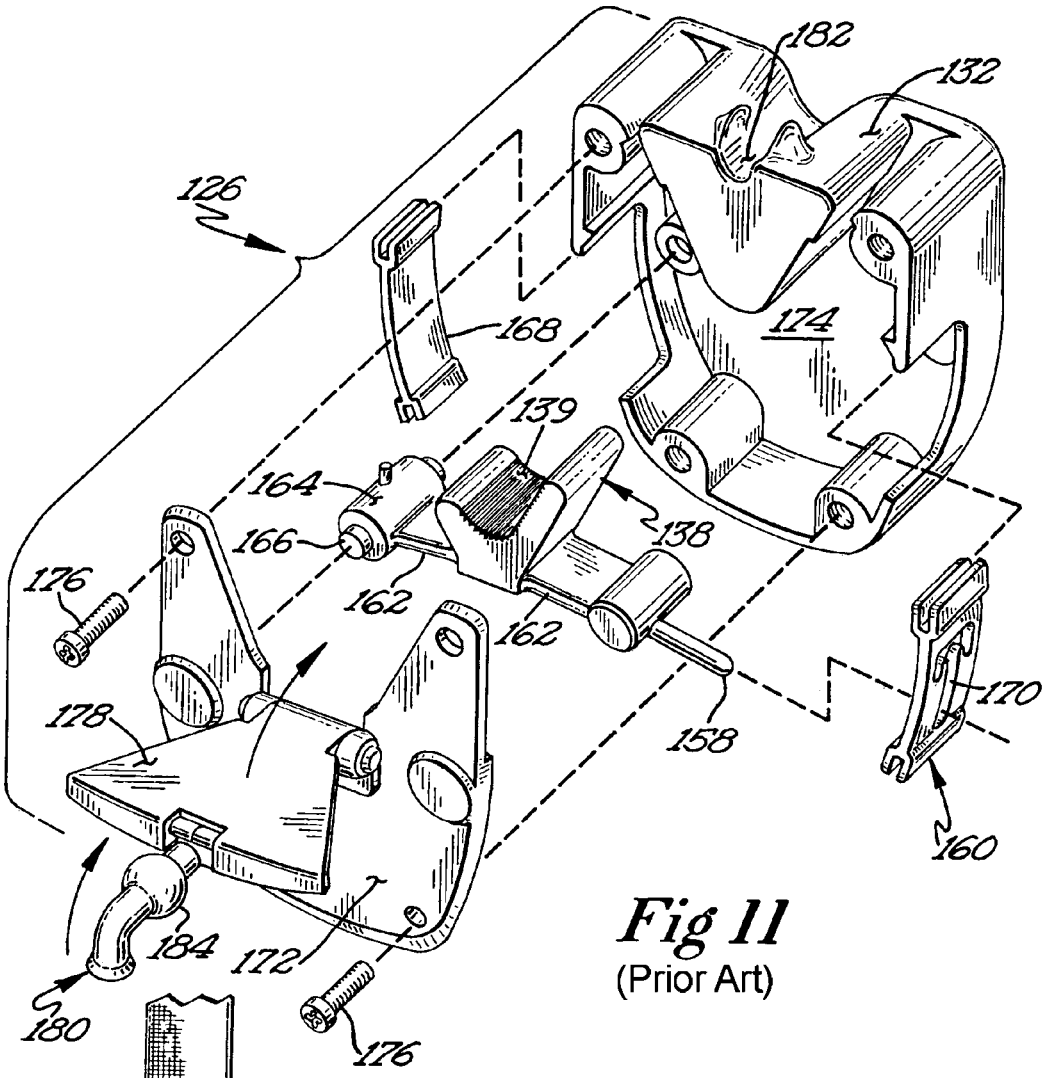
Fig 11 (Prior Art)
FIG. 11 is a close-up exploded view of the alternative embodiment sling clip shown in FIG. 8.

FIGS. 8 and 11 illustrate the alternative embodiment sling clip 126 and associated clamping mechanism formed by a U-shaped upper member 132 and a curved lower member 138. The sling clip 126 has a lever knob 158 that is movable in a T slot 160 between a locked up position and a released down position. The lever knob 158 is connected to the curved lower member 138. Curved lower member 138 pivots from a pivot portion 164 about a pivot point in response to movements of lever knob 158. FIG. 8 shows lever knob 158 in the locked position where strap 20 is clamped into position and prevented from freely sliding between U-shaped upper member 132 and curved lower member 138. The curved lower member 138 may include a straight knurled portion 139 that can more readily frictionally grip strap 20 when curved lower member 138 is pressed next to upper member 132 in the locked position. The front wall 172 is secured to the rear wall by a screw 176 to form the main body of sling clip 126. Sling clip 126 also includes a front door portion 178 with a hinge adjacent to the clamping mechanism formed by the members 132 and 138. This front door portion 178 is engaged with front wall 172 through the hinge. When in the open position, strap 20 can be inserted through front door portion 178 into the slot formed between U-shaped upper member 132 and curved lower member 138. The use of this front door portion 178 allows strap 20 to be inserted into sling clip 126 without the need for removing sling clip 126 from its secured position proximate to the weapon bearer's body B. In addition, the use of this front door portion 178 allows strap 20 to remain secured to weapon 12 while being inserted into sling clip 126. The front door portion 178 can be secured to rear wall 174 in the closed position by a flexible flanged rope 180 by moving flanged portion 184 into slotted section 182 of rear wall 174.

FIG. 9 is a close-up view of the bearing assembly taken along a section line 9-9 of the clamping mechanism formed by members 132 and 138 shown in FIG. 8. Lever 162 has a pivot portion 164 with bearing points 166 formed thereon. The bearing points engage the front 172 and rear 174 walls of sling clip 126 to provide a pivot point for lever 162. The walls 172, 174 are spaced apart from one another by a blank side plate 168 and a T slot side plate 170.

Figure 10:
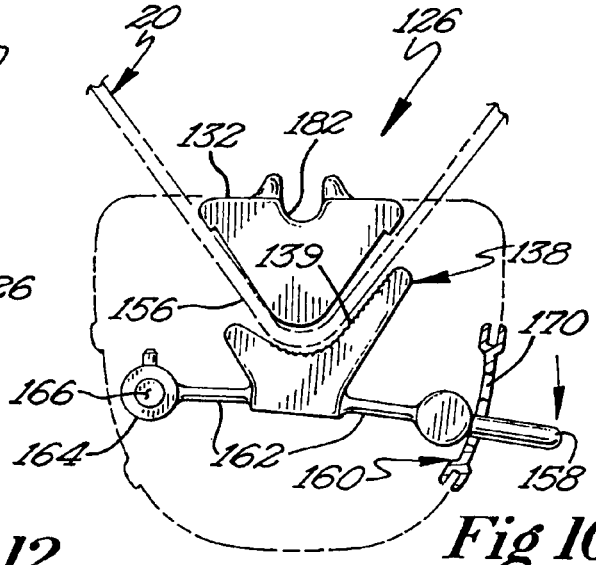
Fig 10 (Prior Art)
FIG. 10 is a close-up of the alternative embodiment clamping mechanism with the remaining portions of the sling clip shown in FIG. 8 being shown in phantom lines.

FIG. 10 is a close-up of the alternative embodiment clamping mechanism formed by members 132 and 138 in an open or released position with the remaining portions of sling clip 126 shown in FIG. 8 being shown in phantom lines. The lever knob 158 has been moved downward in T slot 160 so than strap 20 can freely slide between the U-shared upper member 132 and curved lower member 138.

Figure 12:
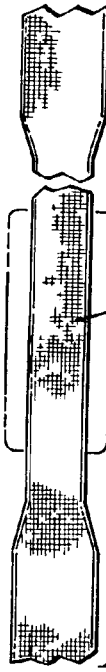
Fig 12 (Prior Art)
FIG. 12 is a close-up view of an alternative embodiment sling taken along a cut line of the sling shown in FIG. 7.

FIG. 12 is a close-up view of an alternative embodiment strap 20 having a tapered portion 156 taken along a cut line 12 of sling 10 shown in FIG. 7. The tapered portion 156 may be added to a strap 20 so that spring clip 126 can be formed with a narrower depth than one would have to be formed to accommodate a wider strap. A wider strap 20 may be desirable especially on the strap portion that would typically fall on a bearer's shoulder. The wider strap portion in the shoulder region would spread the weapon weight over a larger body surface and thus alleviate undue pressure on the bearer's shoulder. At the same time, it is desirable to minimize the size of spring clip 126 so that weight of spring clip 126 can be minimized. A reasonable compromise of these competing desires is to form a tapered portion 156 of strap 20 near the spring clip 126 and perhaps provide a wider portion of the strap near the shoulder. Alternatively, a shoulder pad could be added to strap 20 near the shoulder where the bearer would have the strap located when carrying rifle 12 or other weapon.

FIG. 13 illustrates another weapon sling 120 or lanyard with the sling clip 126 attached at a single point 124 to a handgun 112 that is held by a bearer B, according to another embodiment. In this embodiment, the strap 120 has one end 124 coupled to a butt end 114 of handgun 112. The strap 120 passes through spring clip 126 and operates in substantially the same way to provide a counteracting corrective force C as previously described in reference to strap 20. The strap also includes a self-recoiling spring 152 or other dampening device like elastic member 150 shown in FIG. 7. In this alternative embodiment, the other end 122 of strap 120 may be left unattached to the bearer's clothing or may for convenience be loosely dangled from spring clip 126.

Figure 14:
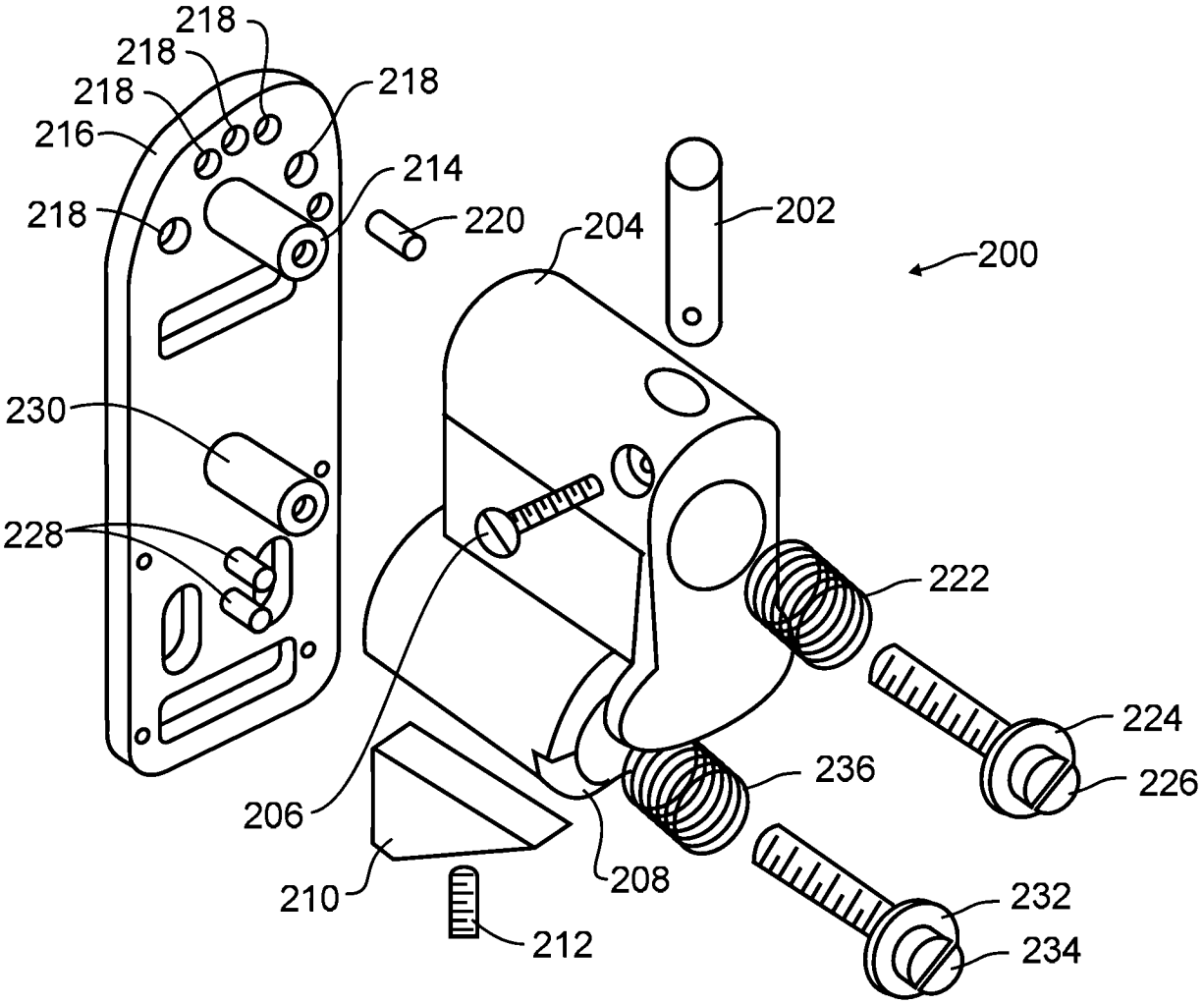
FIG. 14 (Prior Art)
FIG. 14 illustrates an exploded view of another embodiment sling clip.

FIG. 14 illustrates an exploded view of another embodiment of the sling clip that operates in substantially the same manner as sling clip 126 described above in connection with FIGS. 7-13. The sling clip 200 of FIG. 14 includes a lever 202 that is movable between a locked position, a spool position, and an open position. The lever 202 is connected to a pivot barrel 204 by a machine screw 206. The pivot barrel 204 pivots about a pivot pin 214 between a locked position, a spool position, and an open position in response to movements of lever 202. FIG. 14 illustrates lever 202 in the locked position, in which strap 20 is clamped into position and prevented from freely sliding between pivot barrel 204 and a cam 208, which is held in place by a diagonal bracket 210 secured by diagonal bracket pins 228 and a set screw 212. The diagonal bracket 210 may be angled to prevent strap 20 from snagging as the rifle is raised into position.

In the locked position, pivot barrel 204 compresses strap 20 into cam 208, which is supported by a cam pin 230 and is rotatably secured by a washer 232 and a machine screw 234. A spring 236 provides tension to further secure cam 208, while allowing cam 208 to be released quickly. The pivot barrel 204 and cam 208 are supported by a base plate 216 that has holes 218 formed in it to correspond to the locked, spool, and open positions. When lever 202 is actuated by pressing the lever 202 outward and turning, a locating pin 220 is removed from hole 218 corresponding to the locked position, and pivot barrel 204 can be moved to the spool position or the open position. When pivot barrel 204 is moved to the desired position, the user releases lever 202, and locating pin 220 is inserted into hole 218 corresponding to the spool position or the open position by action of a spring 222, which is held in place by a washer 224 and a machine screw 226.

Figure 15:
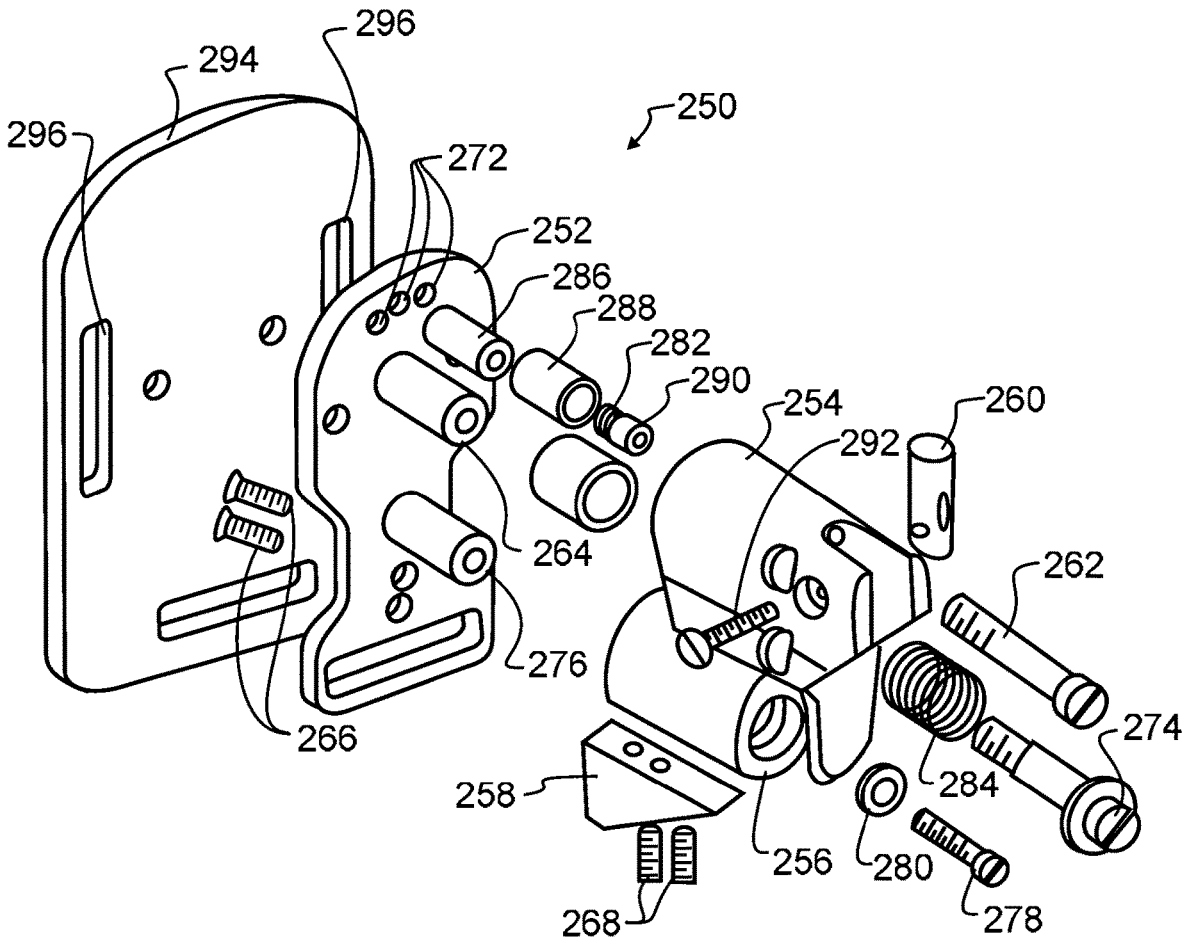
FIG. 15 (Prior Art)
FIG. 15 illustrates an exploded view of another sling clip according to another embodiment.
Figure 16:
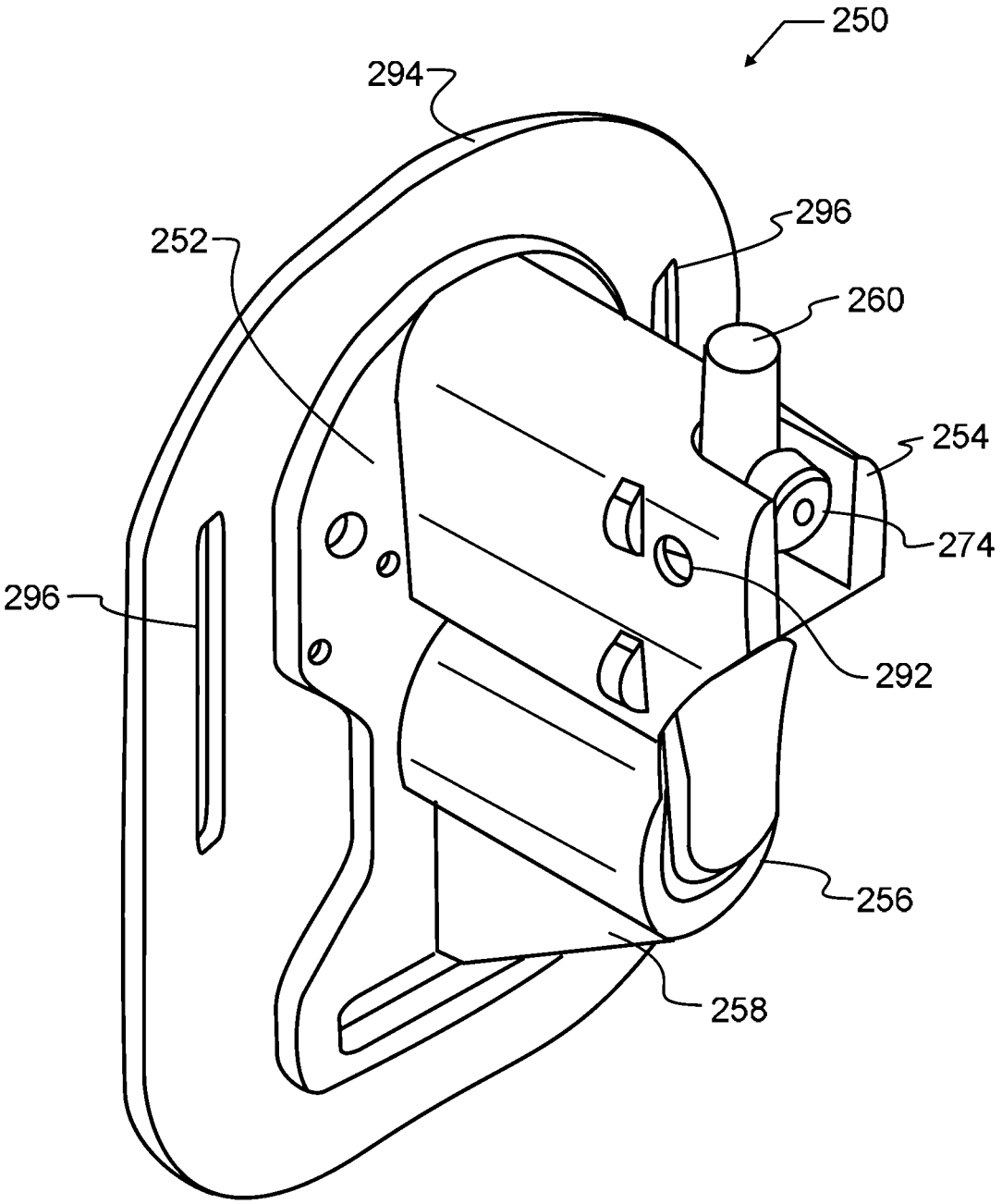
FIG. 16 (Prior Art)
FIG. 16 illustrates the sling clip of FIG. 15 in an assembled form.
Figure 17:
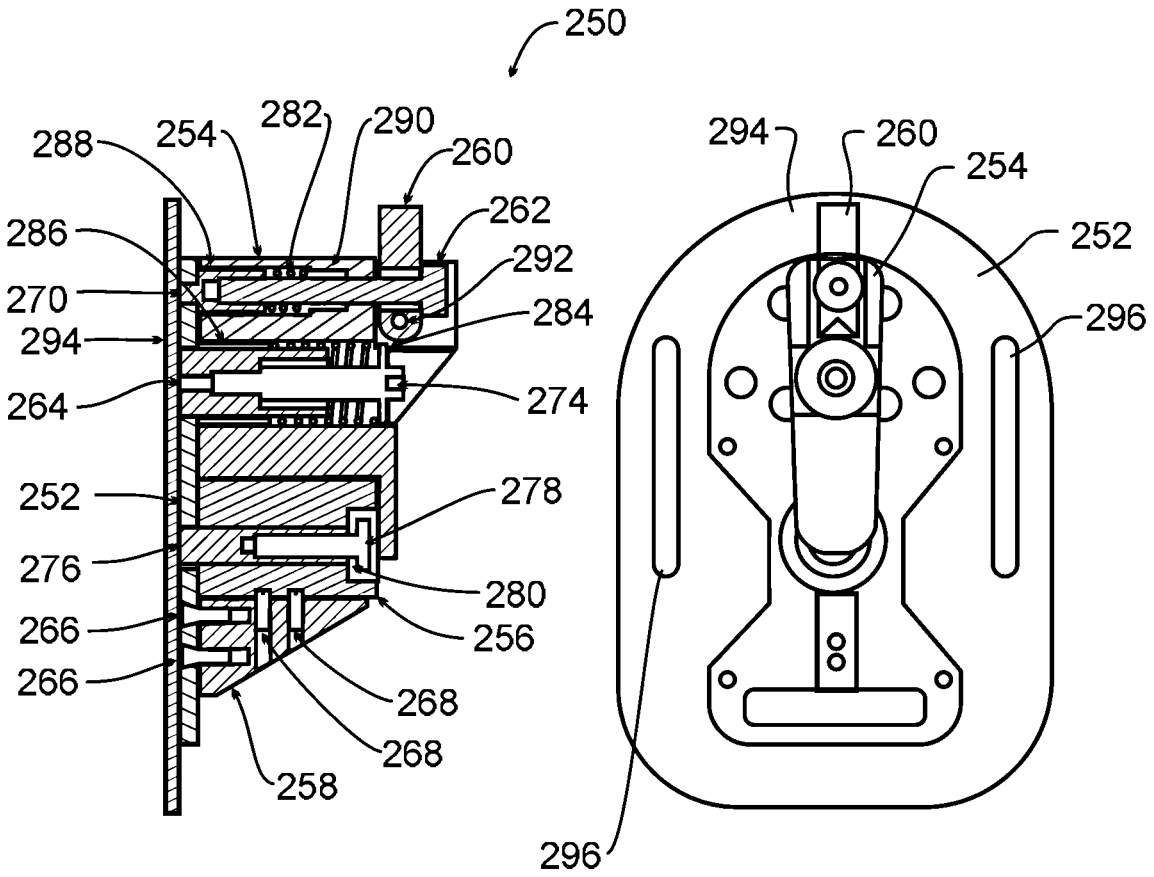
FIG. 17 (Prior Art)
FIG. 17 illustrates a cutaway view of the sling clip of FIG. 15.

FIG. 15 illustrates an exploded view of another sling clip 250 according to another embodiment. FIG. 16 illustrates the sling clip 250 in its assembled form. FIG. 17 illustrates a cutaway view of sling clip 250. A base plate 252 formed from, for example, stainless steel, serves as a mounting bracket for a cam assembly that includes a pivot barrel 254, an eccentric cam 256, and a diagonal bracket 258. A backing pad 294 is mounted on the back of base plate 252 to help dissipate blows that impinge upon sling clip 250 so as to reduce the potential for injury to the bearer B. The backing pad 294 may have slots 296 to accommodate a belt. The backing pad 294 may be formed, for example, from nylon, which is relatively lightweight and durable and can be cut relatively easily. In some embodiments, base plate 252 may be mounted to backing pad 294 so as to be capable of being folded substantially flat with respect to backing pad 294 when the sling clip 250 is not in use.

A lever 260 is movable between an open position, a spool position, and a locked position. The lever 260 is connected to pivot barrel 254 by a bolt 262, which is guided and protected by bushings 286, 288, and 290. A pin 292 traverses the lever 260 and the pivot barrel 254 and screws into the pivot barrel 254 to further secure lever 260 to pivot barrel 254. The pivot barrel 254 pivots about a pivot pin 264, which is for exemplary purposes tig welded to base plate 252, between a locked position, a spool position, and an open position in response to movements of the lever 260. The pivot pin 264 is drilled to accept a shoulder bolt 274, which holds pivot barrel 254 in place.

FIG. 16 illustrates the lever 260 in the locked position, in which cam 256 clamps the strap 20 into position and prevents strap 20 from freely sliding between the pivot barrel 254 and the cam 256. The diagonal bracket 258 holds cam 256 in place and is secured by machine screws 266 and set screws 268. The diagonal bracket 258 may be angled to prevent strap 20 from snagging as the rifle is raised into position. The cam 256 is also held in place by a cam pin 276, which is for exemplary purposes tig welded to the base plate 252 and is drilled to accept a machine screw 278, which along with a washer 280 holds the cam 256 in place. In some embodiments, a shoulder bolt or other fastener can be used in place of machine screw 278. The positioning of cam 256 can be adjusted incrementally using set screws 268 to adapt to straps of various thicknesses and to vary the amount of tension used to secure the rifle. In addition, cam 256 can be set to allow for upper body exercise, which can help develop specific muscles for shooting.

The base plate 252 has a number of chamfered drill holes 272, each of which corresponds to one of the operating positions of sling clip 250—open, spool, or locked. In the open position, strap 20 can be loaded. In the spool position, strap 20 can be moved freely, and the sling clip 250 provides tension. The spool position allows the rifle to be moved freely. In the locked position, strap 20 is compressed between the pivot barrel 254 and the cam 256 and is prevented from moving.

When lever 260 is actuated by pressing the lever 260 and turning it, a locating pin 270 disposed at the end of bolt 262 is retracted from hole 272 in which it is currently located. The lever 260 is then rotated to the open, spool, or locked position and is released. When lever 260 is released, the locating pin 270 is inserted into hole 272 corresponding to the desired position by action of a spring 282. The spring 282 retains locating pin 270 in place until lever 260 is again actuated. In addition, pivot barrel 254 is deeply drilled to allow a spring 284 to move for quick release action. The spring 284 provides tension to retain pivot barrel 254 against base plate 252, while allowing the pivot barrel 254 to move away from base plate 252 when the spring 284 is compressed, e.g., when strap 20 is pulled away from the body of the bearer B.

In the open position, strap 20 can be loaded into sling clip 250. The sling clip 250 can be used to stabilize a shot in the open position by maintaining upward tension on strap 20. When the rifle is lowered, strap 20 will fall out of sling clip 250.

The spool position can be attained by pushing lever 260 outward and rotating it counterclockwise until locating pin 270 drops into hole 272 corresponding to the spool position. In the spool position, the sling clip 250 contains strap 20 until it is released by turning lever 260 back to the open position. The sling clip 250 will also release strap 20 if forced by the quick release action of the spring loaded pivot barrel 254.

Figure 18:
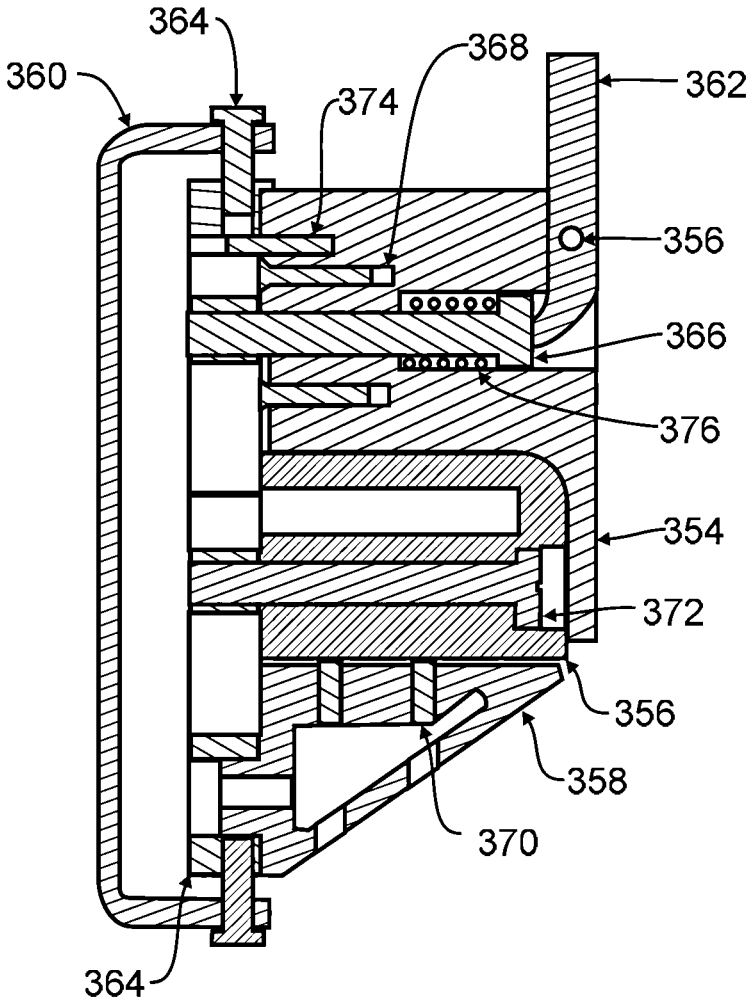
FIG. 18 (Prior Art)
FIG. 18 illustrates a cutaway view of yet another embodiment of the sling clip.

FIG. 18 shows a cutaway view of another sling clip 350 according to another embodiment. A base plate 352 formed from, for example, stainless steel, serves as a mounting bracket for a cam assembly that includes a pivot barrel 354, an eccentric cam 356, and a diagonal bracket 358. A mounting plate 360 is mounted on the back of base plate 352. The mounting plate 360 may have slots (not shown) to accommodate a belt. In some embodiments, base plate 352 may be mounted to mounting plate 360 by shoulder bolts 364 so as to be capable of being folded substantially flat with respect to the mounting plate 360 when sling clip 350 is not in use.

A lever 362 is movable between an open position, a spool position, and a locked position. A machine screw 364 traverses the lever 362 and the pivot barrel 354 and screws into pivot barrel 354 to secure lever 362 to the pivot barrel 354. The pivot barrel 354 pivots about a shoulder bolt 366, which holds pivot barrel 354 in place and is guided and protected by a bushing 368, between a locked position, a spool position, and an open position in response to movements of lever 362.

In the locked position, cam 356 clamps strap 20 into position and prevents strap 20 from freely sliding between pivot barrel 354 and cam 356. The diagonal bracket 358 holds cam 356 in place and is welded to base plate 352. Set screws 370 can be used to incrementally adjust the positioning of cam 356 to adapt to straps of various thicknesses and to vary the amount of tension used to secure the rifle. The diagonal bracket 358 may be angled to prevent strap 20 from snagging as the rifle is raised into position. The cam 356 is held in place by a machine screw 372. In some embodiments, a shoulder bolt or other fastener can be used in place of machine screw 372. In addition, cam 356 can be set to allow for upper body exercise, which can help develop specific muscles for shooting.

The base plate 352 has a number of chamfered drill holes, each of which corresponds to one of the operating positions of sling clip 350—open, spool, or locked. In the open position, strap 20 can be loaded. In the spool position, strap 20 can be moved freely, and the sling clip 350 provides tension. The spool position allows the rifle to be moved freely. In the locked position, strap 20 is compressed between pivot barrel 354 and cam 356 and is prevented from moving.

When lever 362 is actuated by pressing lever 362 and turning it, a locating pin 374 is retracted from the hole in which it is currently located by action of a spring 376. The lever 362 is then rotated to the open, spool, or locked position and is released. When lever 362 is released, the locating pin 374 is inserted into the hole corresponding to the desired position by action of spring 376. The spring 376 retains locating pin 374 in place until lever 362 is again actuated.

FIGS. 19 through 25 show the weapon sling and sling clip as they may be used in various positions and configurations. In the position shown in FIG. 19, for example, a rifle 300 is shown in a raised position. The rifle 300 is attached to a sling 302 by a pair of snap hooks 304 located proximate a muzzle end 306 of the rifle 300 and by another snap hook (obscured in FIG. 19) proximate a butt end of the rifle 300 (obscured in FIG. 19). The sling 302 has a relatively inelastic portion whose length can be adjusted using sliders 308. The length may be adjusted to the user's line of sight ahead of time. When the bearer raises rifle 300, the bearer will simply lift up their arms until sling 302 is tensioned. This enables the bearer to apply an agonistic force, meaning that only the lifting muscles need to be activated. Since the bearer does not need to activate antagonistic, or opposed, muscle groups to slow down and control the final position of the rifle, these agonistic muscles can be fired or contracted rapidly and decisively, and sling 302 will act as the antagonist, controlling in part the ultimate elevation and stopping point of the rifle. The bearer may then apply a relatively large lifting force with both left and right arms, which will rapidly raise the rifle, and then sling 302 will catch the rifle at the intended upper travel point. Once the rifle reaches the intended point of travel, then sling 302 will hold the rifle in an antagonistic way against the bearer's lifting force. This will reduce muzzle wobble and allow the bearer to acquire a sight picture rapidly by quickly aligning the sight, shoulder, and eye. The amount of tension in sling 302 can be controlled via slider 308 to optimize the user's experience, e.g., to take advantage of the user's "sweet spot," which will be a combination determined not only by the dimensions of the user, strap and gun, but also by how much upward force the user prefers to apply and also by the weight of rifle 300. The length of sling 302 may not need to be adjusted between certain positions, e.g., between standing, kneeling, and sitting positions. Some adjustment may be needed, for example, when transitioning to or from a prone position. When the user is in the prone position, the sling may need to be lengthened by moving slider 308 forward. In some embodiments, sling 302 may be marked for the appropriate slider positions for each position of the user.

Sling 302 passes through a sling clip 310, which may be implemented as any of the embodiments described above in connection with FIGS. 1-18, and which is contained in a pouch 312 that is located on a belt 314 worn by the user. The sling clip 310 is also connected to a leg strap assembly 316 that provides tension for greater stability. With the leg strap assembly 316 attached to a leg of the user, the user's leg muscles can assist in the task of drawing the butt of the rifle tight to the user's shoulder, and the tension of sling 302 can be increased by straightening the leg.

Figure 19:
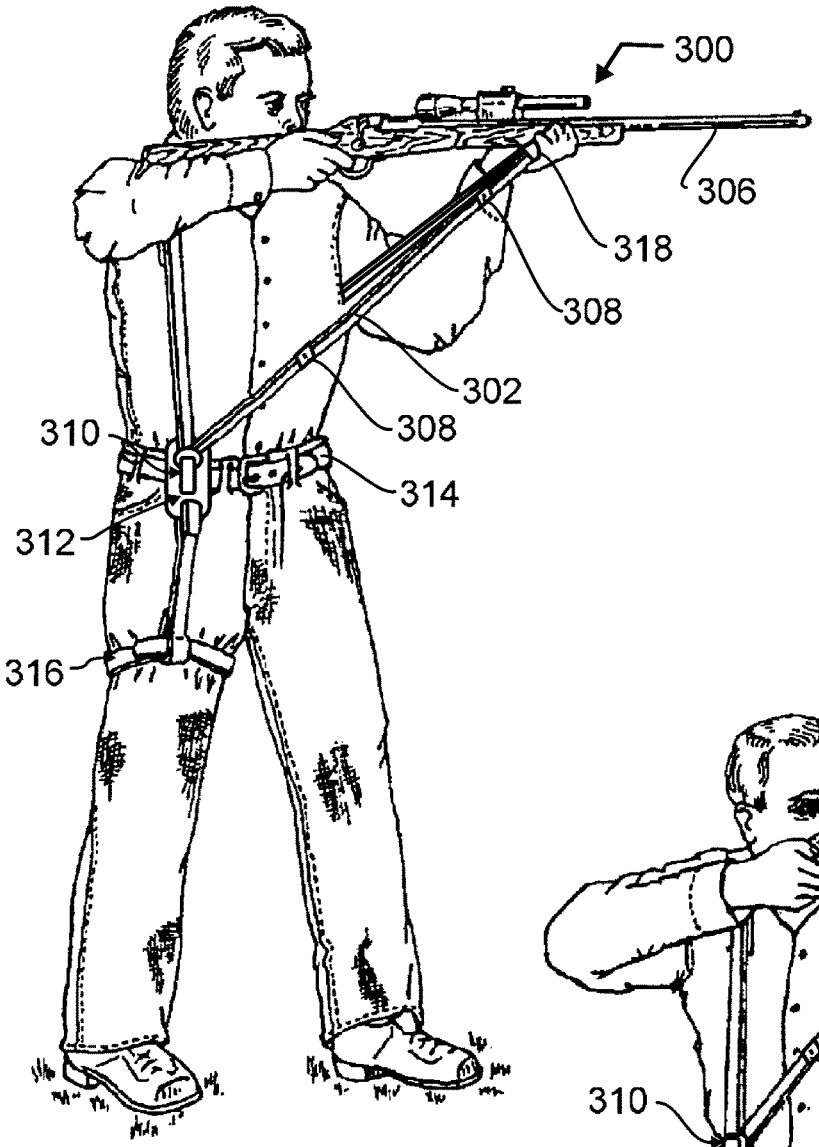
FIG. 19 (Prior Art)
FIG. 19 illustrates a sling system in use with a rifle in a raised position.
Figure 22:
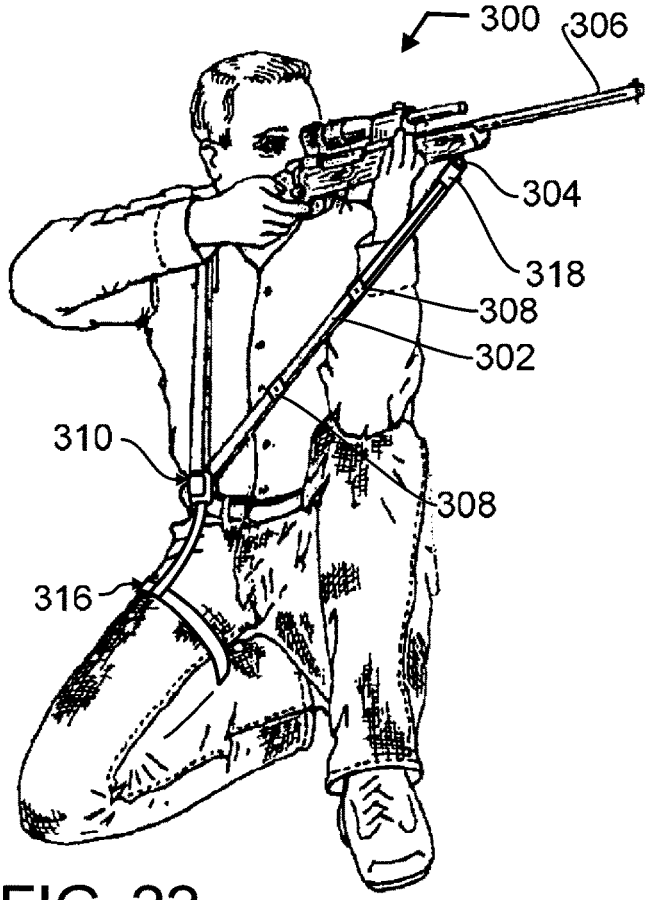
FIG. 22 (Prior Art)
FIG. 22 illustrates a sling system in use with a rifle in another shooting position.

As illustrated for example in FIGS. 19 and 22, sling 302 extends from sling clip 310 to the butt end of rifle 300 in an essentially vertical direction. This orientation is preferred, since in this orientation, sling 302 will also apply an antagonistic force to the shooter's shoulders upon firing. When rifle 300 is fired, there is a large impulse force applied through the rifle butt end driving the shooter's shoulders backward. It is this force that balances the forces required to propel the bullet forward. However, if strap 302 is relatively inelastic, then to move the shooter's right shoulder backward would require lengthening strap 302 between the rifle butt and sling clip 310. Since sling clip 310 is locked, this lengthening is not possible, meaning strap 302 will resist backward shoulder movement, thereby further helping to resist muzzle flip.

Figure 20:
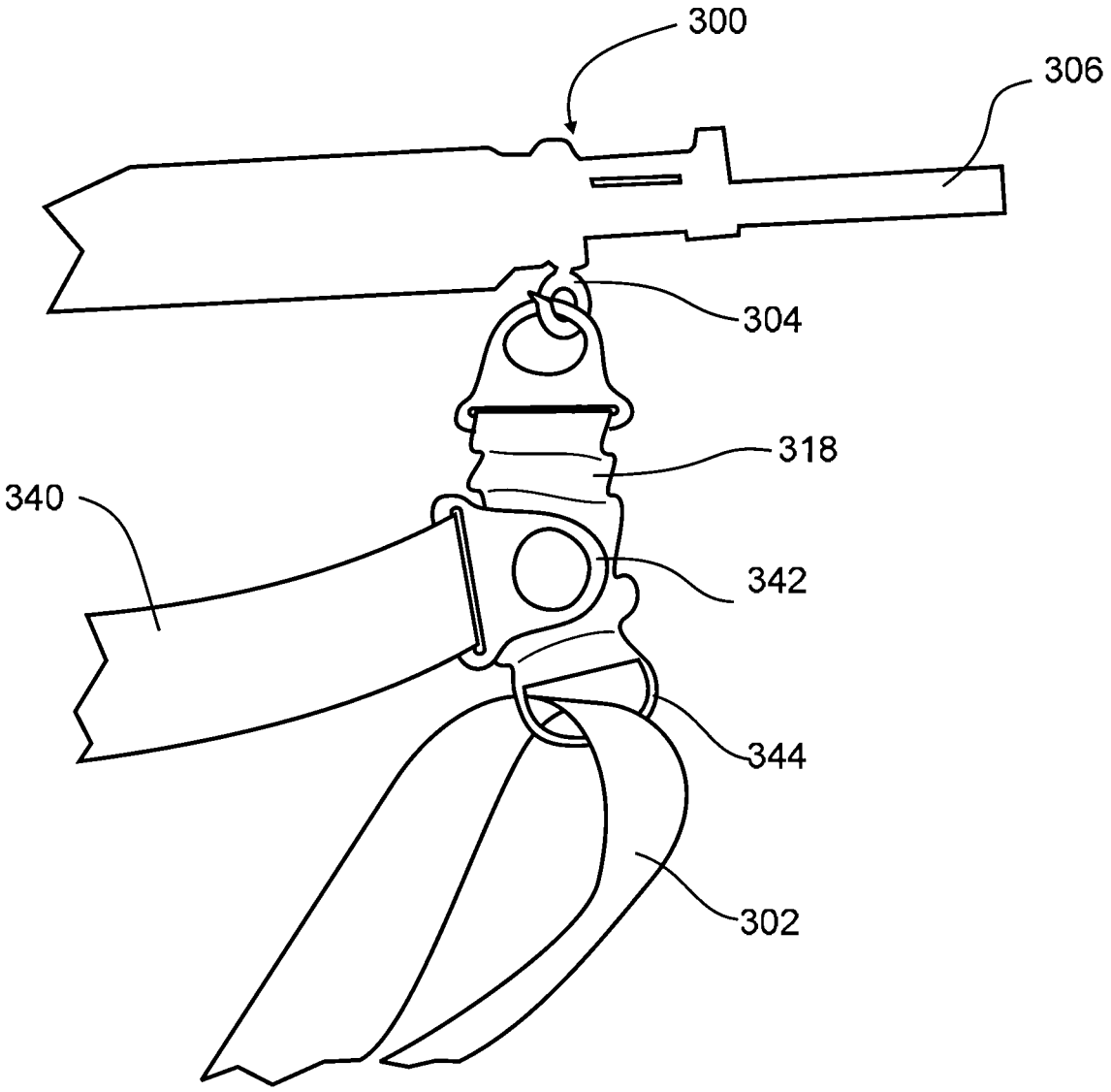
Fig. 20 (Prior Art)
FIG. 20 illustrates a portion of the configuration of FIG. 19.

FIG. 20 illustrates a portion of the configuration of FIG. 19, in particular, the portion located proximate the muzzle end 306 of the rifle 300. The sling 302 has a relatively elastic portion 318 that is encased in a tubular nylon encasing. The elastic portion 318 provides shock absorption, rapid antagonistic tension increase when the rifle is approaching the upper limit of travel, and facilitates rapid sight realignment for wobble. In addition, elastic portion 318 allows some length adjustment when sling 302 is locked in place by sling clip 310. The elastic portion 318 may optionally be connected to a back strap portion 340 of sling 302 by an oval loop 342 that engages a snap hook for additional lateral stability. A D-ring 344 also attaches to the elastic portion 318 and facilitates movement of sling 302.

Figure 21:
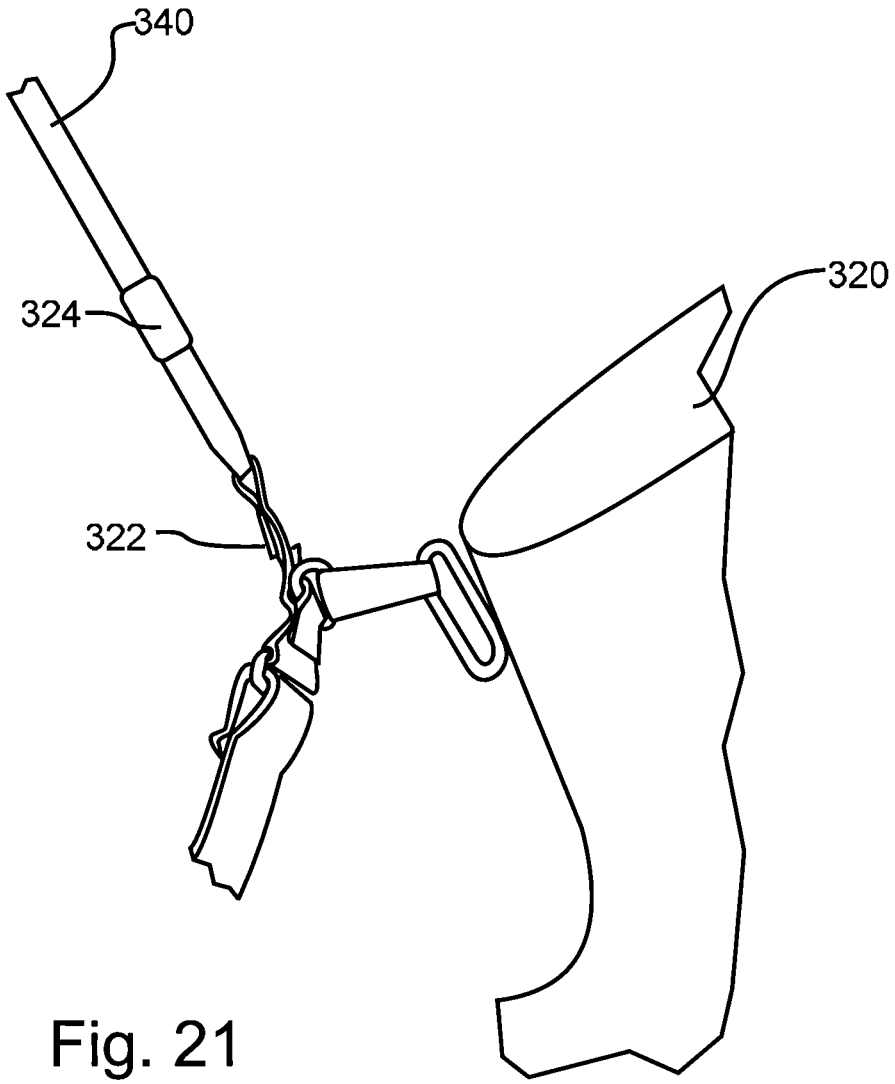
Fig. 21 (Prior Art)
FIG. 21 illustrates another portion of the configuration of FIG. 19.

FIG. 21 illustrates a portion of the configuration of FIG. 19 for a right-handed user. As shown in FIG. 21, a butt end 320 of rifle 300 is suspended from the right shoulder of the bearer. Sling 302 is attached to rifle 300 by a snap hook 322 located proximate the butt end 320. Sling 302 has a side release buckle 324 forming part of the back strap portion 340 of sling 302. The side release buckle 324 can be detached quickly to convert sling 302 from a three-point sling, retained at the muzzle end 306, the butt end 320, and the sling clip 310, to a two-point sling. The back strap portion 340 of sling 302 may terminate in a snap hook (not shown in FIG. 21) that engages a D-ring on the belt 314.

FIG. 22 illustrates sling 302 as it may be used in another shooting position. As shown in FIG. 22, sling 302 travels from the butt end 320 of rifle 300 over the right shoulder of the user, then under the left shoulder of the user. The sling 302 then attaches to snap hook 304, which is located near the muzzle end 306 of rifle 300.

Figure 23:
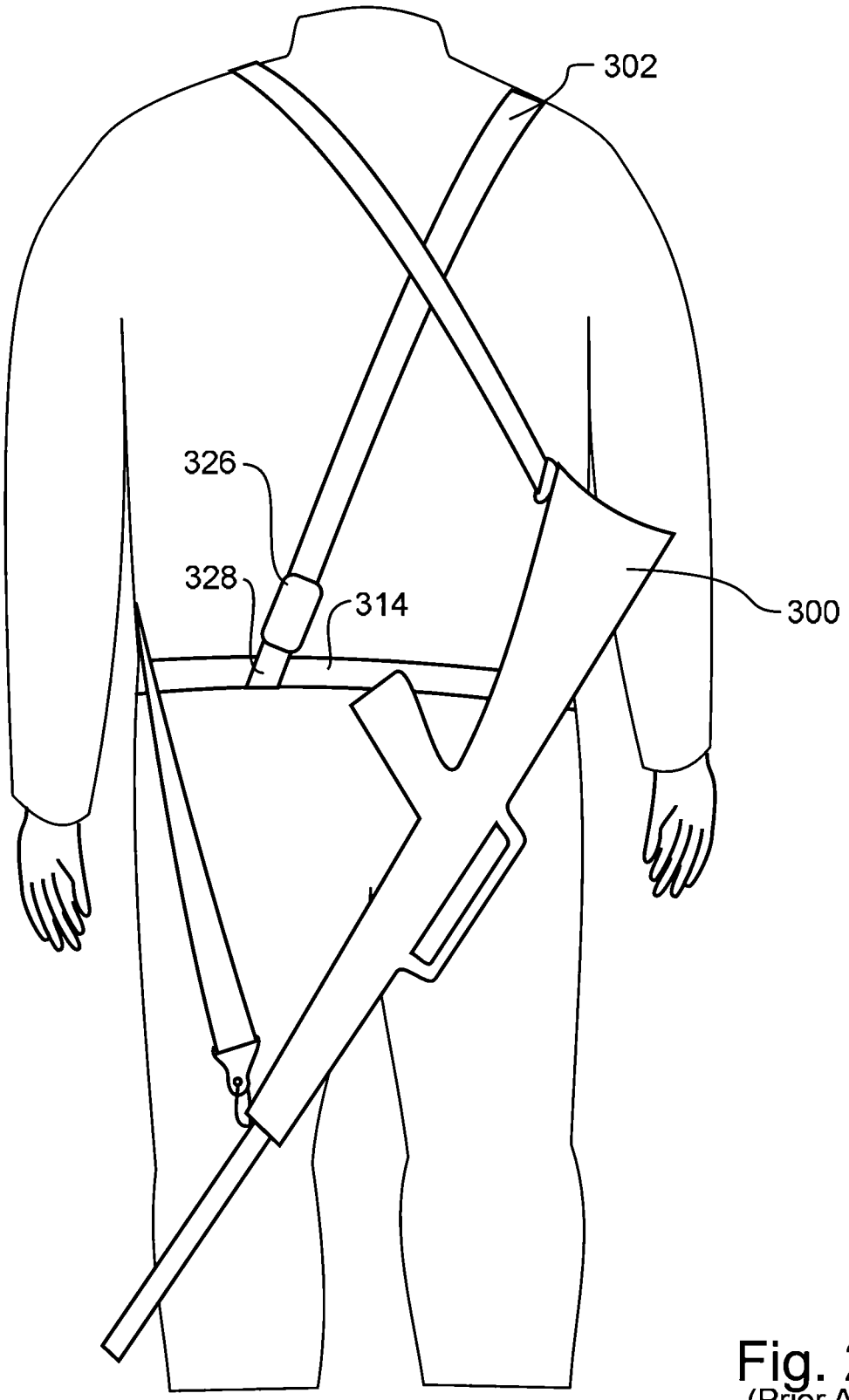
Fig. 23 (Prior Art)
FIG. 23 illustrates a rear view of a sling system in a backpack-style carry configuration.

FIG. 23 illustrates a rear view of the sling 302 used in a backpack-style carry mode. In this mode, a rectangular ring 326 located near a far side of the sling 302 attaches to belt 314 and captures a snap hook 328. In some other modes, the rectangular ring 326 facilitates conversion of the sling 302 to a two-point configuration and facilitates supporting rifle 300 in a hands-free mode or when rifle 300 is hanging from the right shoulder of the user. The sling 302 can be readily reconfigured to a three-point configuration by disengaging snap hook 328 and attaching snap hook 328 to the front end of rifle 300.

Figure 24:
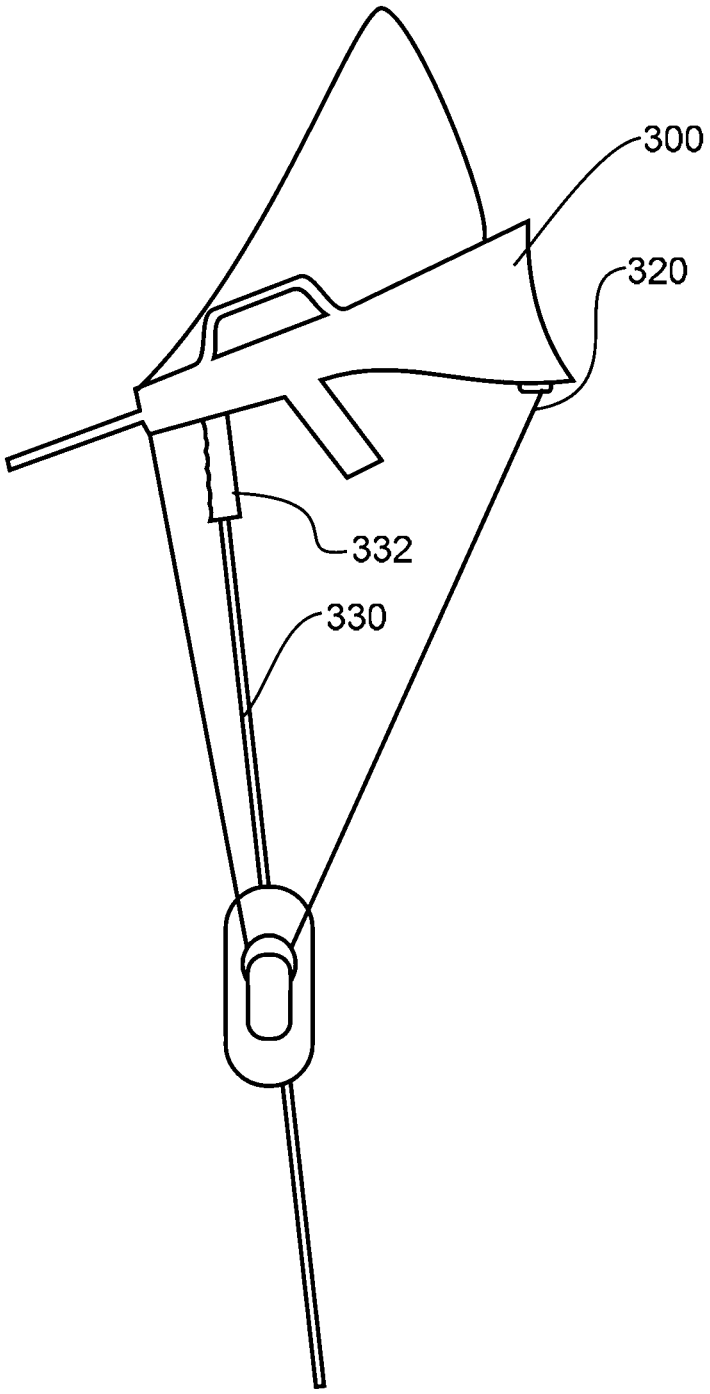
Fig. 24 (Prior Art)
FIG. 24 illustrates a sling system employed in conjunction with a shooting stick.

FIG. 24 illustrates sling 302 as it may be used in connection with a shooting stick 330. The shooting stick 330 typically has a recessed portion to hold rifle 300 and a hand grip 332. The shooting stick 330 provides front end balance for rifle 300 and is commonly used in hunting applications, and less commonly in military applications. The sling 302 can be employed in either a two-point or a three-point configuration with shooting stick 330. By attaching sling clip 310 to the shooting stick 330, greater stability can be achieved by improving triangulation of forces. In addition, sling clip 310 provides a measure of control of the butt end 320 of rifle 300.

Figure 25:
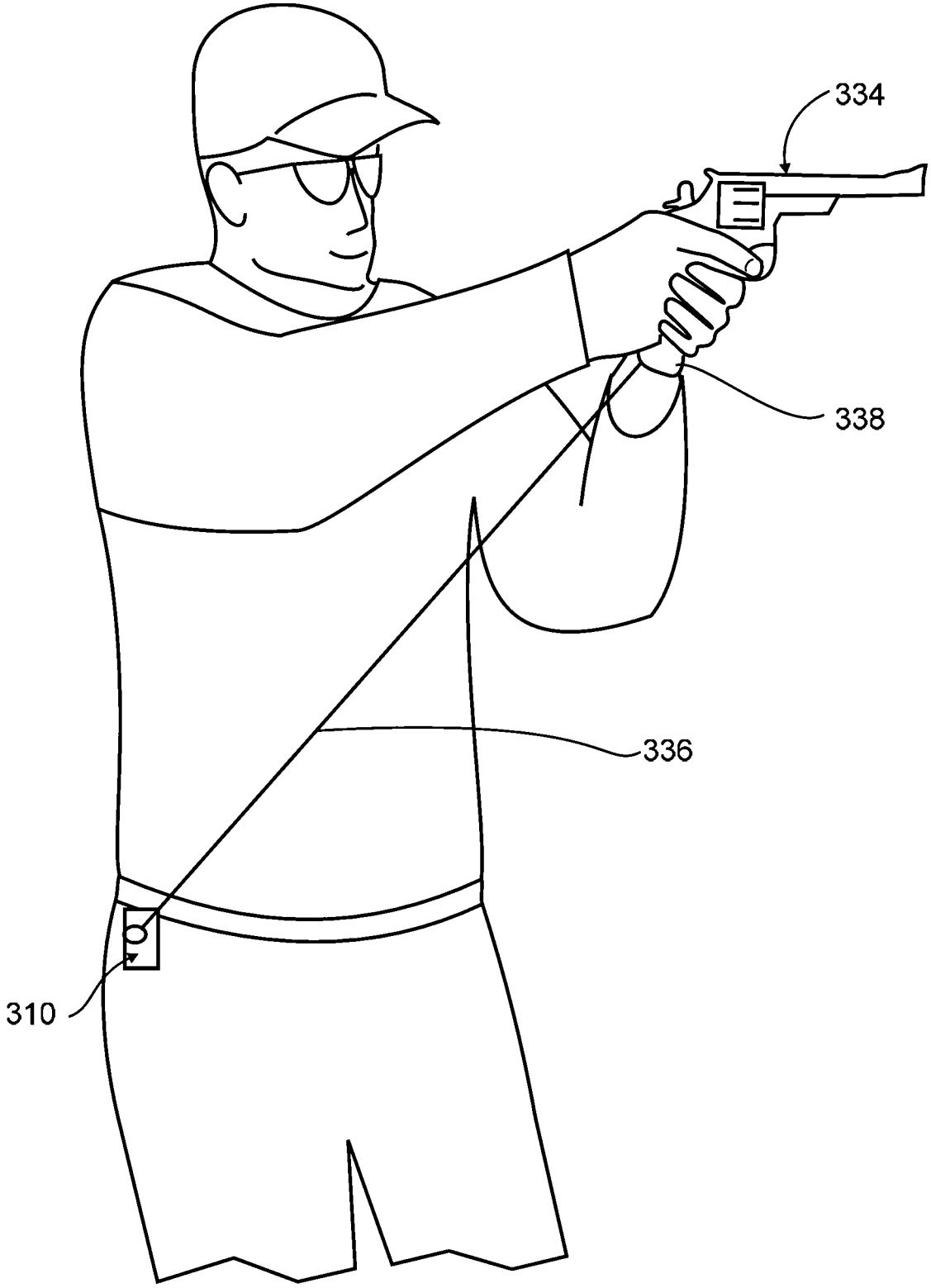
Fig. 25 (Prior Art)
FIG. 25 illustrates a sling system in use with a pistol.

FIG. 25 illustrates sling clip 310 as it may be used in connection with a pistol 334. As shown in FIG. 25, a sling 336 is connected near a butt end 338 of the pistol 334. The sling 336 passes through sling clip 310 and may be locked by actuation of the lever as described above.

Figure 26:
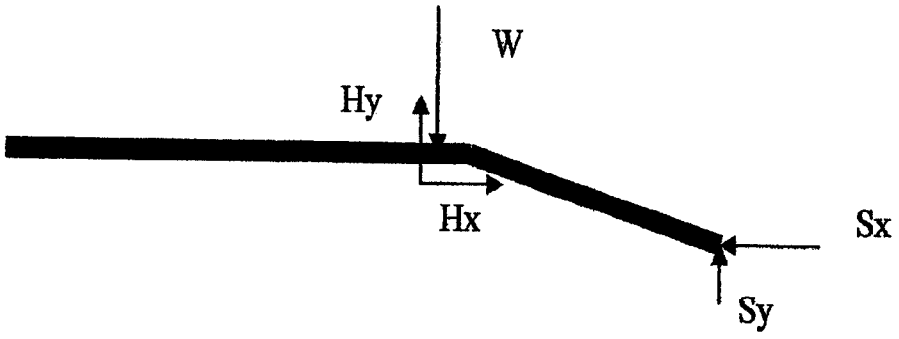
FIG. 26 (Prior Art)
FIG. 26 conceptually illustrates force multipliers in the absence of a sling system.

As described above in connection with FIGS. 1-25, a sling clip and sling that together form a sling lock system can improve the biomechanics involved in the control and firing of a gun. FIG. 26 shows how force multipliers are affected when no sling lock system is used. The weight of the gun is represented by a vector W. The offside/weak arm supports the weight of the gun and pulls the gun against the shoulder, as shown in FIG. 26 as vectors $H_y$ and $H_x$. The vertical and horizontal vector components of the force exerted by the shoulder are indicated by vectors $S_y$, and $S_x$, respectively. The gun has been displaced from the shooter to illustrate the forces more clearly. The vertical force on the gun is primarily created by the strong shoulder muscles (shoulder flexors) while the horizontal force is mostly due to the elbow flexor muscles (biceps and *brachialis*). When the shooter pulls the gun firmly against the shoulder, the elbow flexors can tire and wobble. Furthermore, the shooter must exert co-contraction to hold the gun in position, meaning opposed muscle groups work as agonists and antagonists to attempt to keep the gun in position. It is difficult neurologically to exactly oppose co-contracted muscles in a steady manner. Consequently, many marksmanship lessons teach gently swaying the gun through a sideways FIG. 8 pattern, so that opposed muscles are alternately slightly fired and then relaxed.

Since the antagonist muscles are effectively increasing the weight of the gun, this is extra energy required to support the gun in both the agonist and antagonist muscle groups. Consequently, with a prior art two-point sling or when completely without a sling, the shooter will tire much more quickly than with the present invention, causing more muscle fibers to be brought into use, and leading to greater wobble and less control than in the present invention. Prior art two-point slings only anchor the muzzle end of the rifle, meaning at the butt end the shooter must still operate with co-contracting opposed agonist and antagonist muscles.

Figure 27:
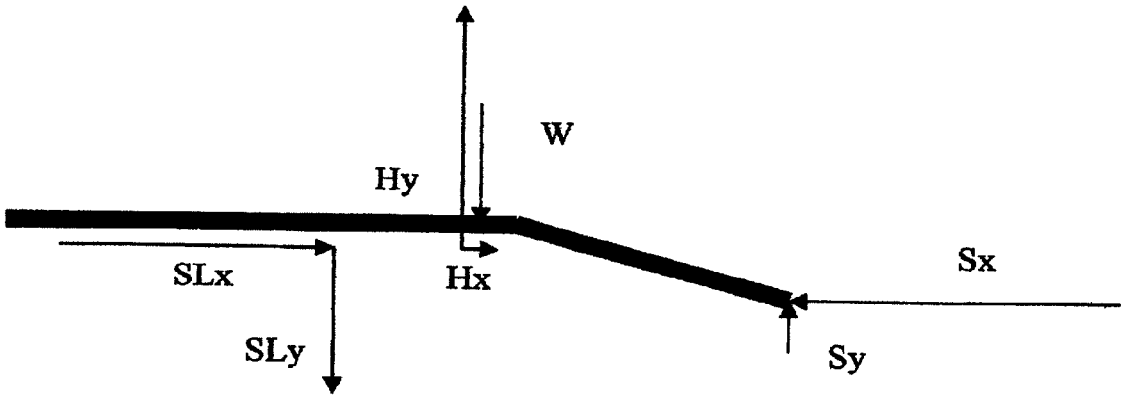
FIG. 27 (Prior Art)
FIG. 27 conceptually illustrates force multipliers in the presence of a sling system.

FIG. 27 shows the biomechanics of the force multiplier forces when a sling lock system is deployed with the gun. The expected result is to reduce the amount of elbow flexor activity and fatigue. As the gun is raised by the strong shoulder flexors, tension develops in the strap. The force exerted by the strap has a vertical vector component indicated by a vector $SL_x$ and a horizontal vector component indicated by a vector $SL_y$. The horizontal component $SL_x$ of the strap force anchors the rifle against the shoulder, reducing or eliminating the need to recruit the elbow flexors. This is expected to reduce the risk of wobble due to weak or fatigued elbow flexors. The strap does, however, pull down on the rifle.

Likewise, rather than the sideways FIG. 8 motion of the prior art, with the present invention there is no need for this continuous movement, since there is little or no use of opposed muscles, and instead muscles are used almost entirely in an agonistic way. Further, as is well known in the art of marksmanship, a shooter will normally perform much better in a more relaxed state. By not drawing on opposed muscle groups, but rather permitting the muscles to operate solely or nearly so in an agonist manner, the shooter will also be more relaxed and exhibit better control.

Figure 28:
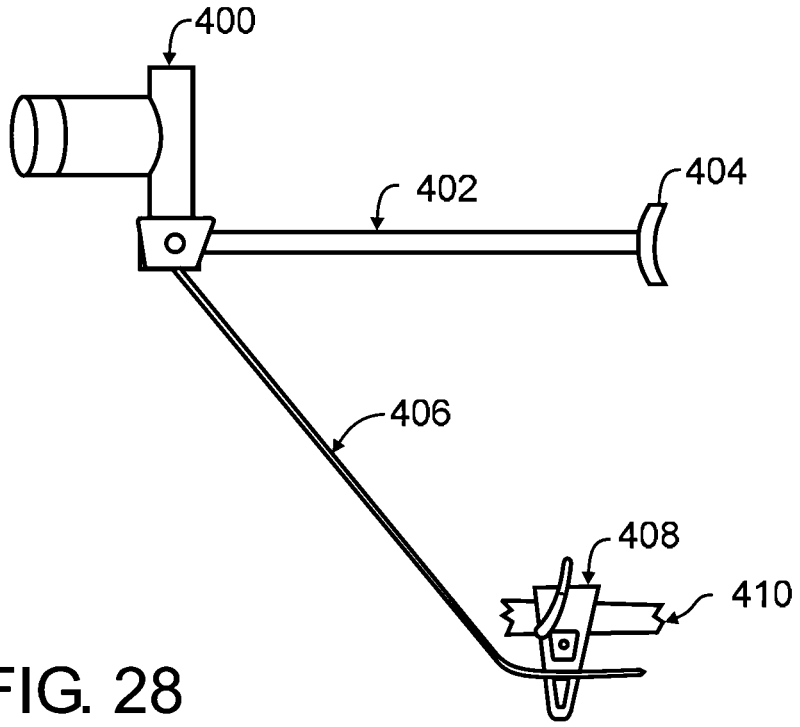
FIG. 28 (Prior Art)
FIG. 28 illustrates a sling system in use with a camera.

Several of the embodiments have been described above as being usable with rifles. As disclosed above, however, the term "weapons" is broadly defined to include shotguns, handguns, bows, crossbows and other like apparatus. FIG. 28 illustrates a sling lock system in use with a camera 400 mounted on a stock 402. The stock 402 may be telescoping or nontelescoping and terminates in a shoulder pad 404 that can be drawn tight to a photographer's shoulder, somewhat like the butt end of the rifle described above. A sling strap 406 passes through a sling clip 408, which may be implemented as any of the embodiments described above. The sling clip 408 is secured to a belt 410, which is worn around the waist of a user (not shown in FIG. 28).

The sling clip 408 can be used to enhance the stability of a camera 400 relative to holding the camera 400 in the photographer's hands. This enhanced stability is particularly advantageous in the case of heavy cameras, especially in situations in which the photographic subject is located far from the photographer. In such situations, it can be difficult to frame the subject, particularly if the subject is moving. Stabilizing the camera 400 with the sling lock system facilitates framing the subject by reducing unintentional movements of the camera 400. Once again, this stabilization can primarily be attributed to the elimination of the need to operate muscles in antagonistic manner.

As may be apparent then, the present invention offers a number of advantages and benefits over the prior art. The present invention slows down muzzle wobble and reduces wobble excursion. A more secure shoulder position is provided and more quickly attained, while at the same time the muscular demand normally required is reduced. Upon firing, the present invention helps to counter horizontal torque reducing horizontal twist, and counters vertical torque to reduce flip.

In many applications, particularly for combat purposes, it is desirable to reduce weapon weight. This permits a soldier to carry other combat loads, including munitions, water and other essentials. Unfortunately, and limiting the weight reduction, there is more kick upon firing a lighter weapon with the same munition, leading to less accuracy. This is particularly true during rapid fire. The present invention applies appropriate antagonistic forces independently of weapon weight. Consequently, a lighter weapon may still be used to obtain great accuracy and with rapid firing rates.

Example I

A series of tests were conducted firing a rifle with, and without the present invention. The test was conducted using a laser marker to continuously illuminate the aim of a rifle barrel, permitting the deviation from a target to be determined through each of a plurality of shots fired. From the tests, the present invention reduced the deviation to a factor of 50 to 66 percent of the deviation without the present invention.

Figure 29:
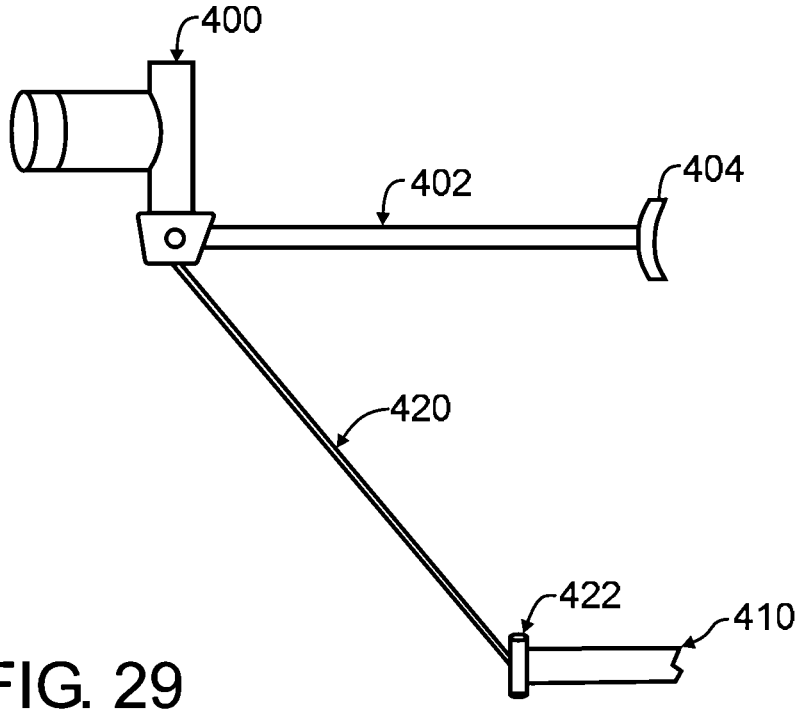
FIG. 29 (Prior Art)
FIG. 29 illustrates a modular camera support system.
Figure 31:
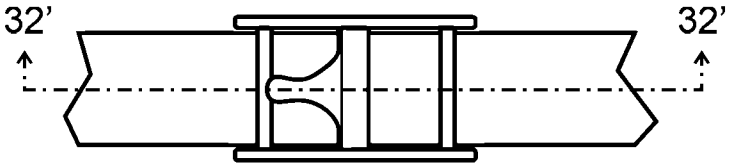
FIG. 31 (Prior Art)
FIG. 31 illustrates the sling clip of FIG. 30 from top plan view.
Figure 32:
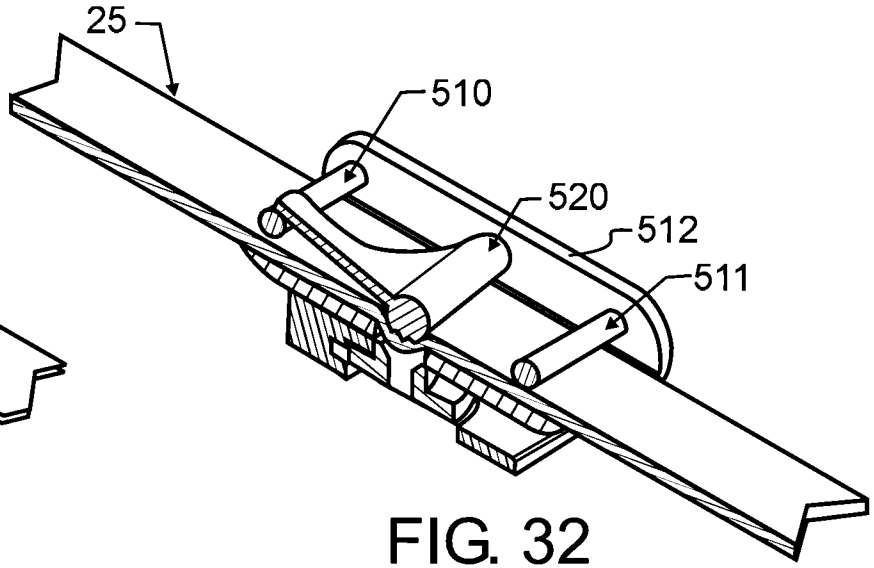
FIG. 32 (Prior Art)
FIG. 32 illustrates the sling clip of FIG. 31 from a section view taken along line A-A of FIG. 31.

FIG. 29 illustrates an alternative embodiment in which the sling strap 406 of FIG. 28 is replaced by a monopod 420, which may be telescoping or non-telescoping. The monopod 420 is retained in a flag holder 422, which is secured to belt 410. While not shown, additional members may extend from camera 400 toward the ground or another supporting surface, such that the camera 400 is supported by a bipod or tripod configuration.

Figure 30:
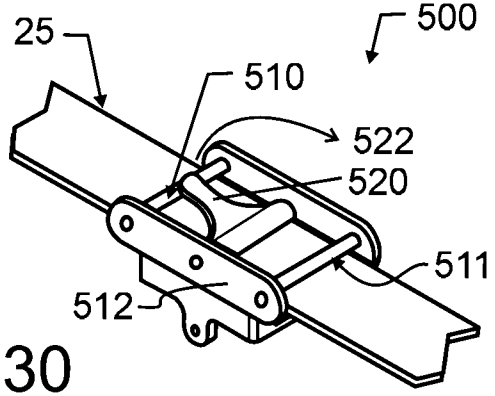
FIG. 30 (Prior Art)
FIG. 30 illustrates another alternative embodiment weapon sling clip with a detachable attachment.
Figure 33:
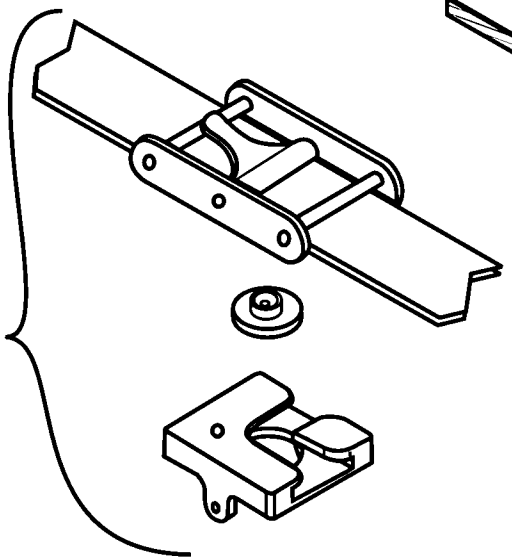
FIG. 33 (Prior Art)
FIG. 33 illustrates the sling clip of FIG. 30 by exploded view.
Figure 36:
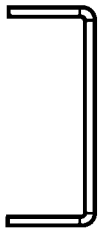
FIG. 36 (Prior Art)
FIGS. 34-39 illustrate an alternative embodiment strap guide rod that may be used in the sling clip of FIG. 30, from top, side, end, and bottom views, and from flat geometry during fabrication from top and side views, respectively.

FIGS. 30-33 illustrate an alternative embodiment sling clip 500 that is selectively detachable from sling strap intermediate portion 25. The lock cam 520 illustrated therein is designed to pivot in the direction shown by arrow 522 as illustrated in FIG. 30. From the sectional view of FIG. 32, it will be apparent that as lock cam 520 is pivoted about the axis of lock cam rotation, transverse to strap 25 and strap guide rods 510, 511, the thickness of lock cam 520 and surface texture or features change, which causes lock cam 520 to relatively squeeze strap 25 within the strap guide and resist relative movement between the strap guide rods and the strap as illustrated in FIGS. 30-33, or alternatively allow relatively free movement therebetween.

FIGS. 34-37 illustrate in greater detail alternative embodiment strap guide 512 that may be used in the sling clip of FIG. 30, from top, side, end, and bottom views. A pair of sidewalls 513, 514 engage with the edges of strap 25 to keep strap 25 from moving side-to-side within alternative embodiment sling clip 500. A pair of transversely oriented bottom guides 515, 516 work in tandem with strap guide rods 510, 511 to keep strap 25 from moving up and down. Furthermore, and as best seen from FIG. 32, the small gap between bottom guides 515, 516 also permits lock cam 520 to press strap 25 down and somewhat between bottom guides 515, 516, to improve the holding strength of alternative embodiment strap guide 512.

Figure 39:
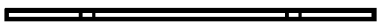
FIG. 39 (Prior Art)
Figure 35:
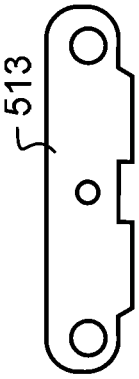
FIG. 35 (Prior Art)
Figure 38:
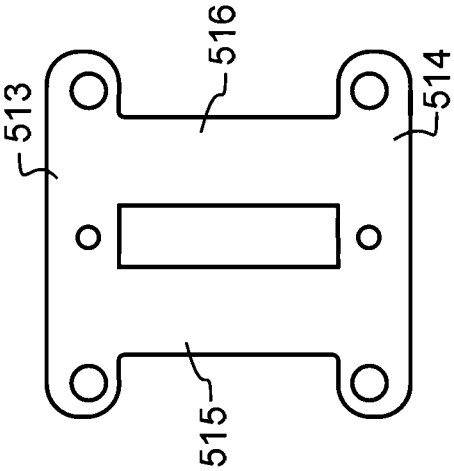
FIG. 38 (Prior Art)
Figure 34:
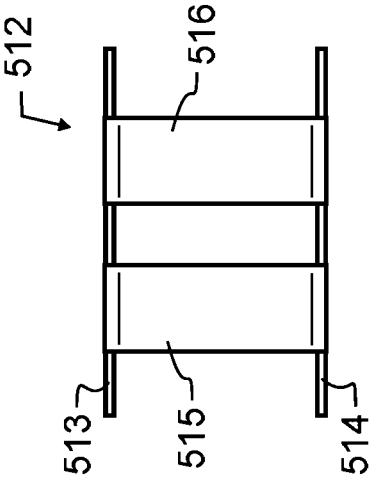
FIG. 34 (Prior Art)
Figure 37:
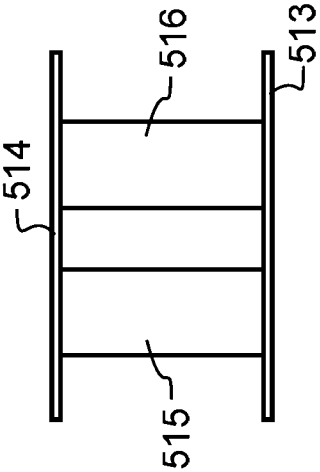
FIG. 37 (Prior Art)
Figure 40:
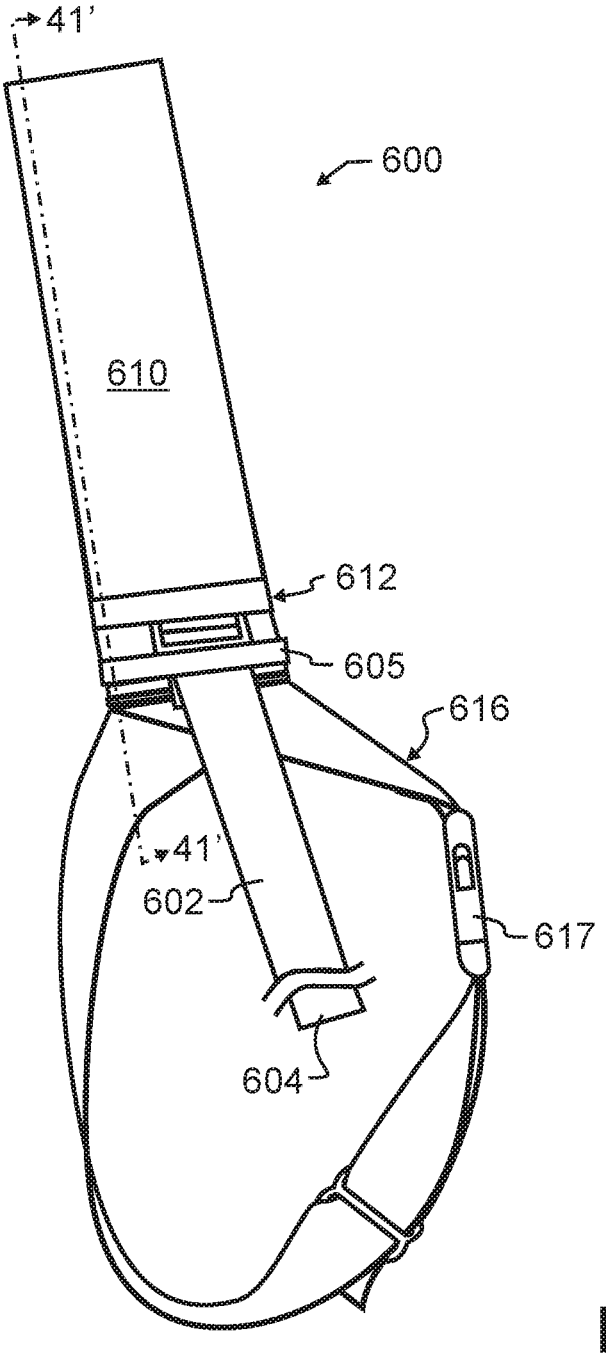
FIG. 40 illustrates a first preferred embodiment force coupler in a closed and generally operational position, but disconnected from a sling clip or person, from a front elevational view.

This alternative embodiment strap guide rod may be beneficial in higher volume applications. From the illustrations of FIGS. 38 and 39, this guide may be fabricated entirely from flat sheet stock through a relatively simple punching operation or sequence, followed by the bending of both ends. As those more familiar with fabrication will recognize, this will greatly simplify the production of the strap guide.

FIGS. 40-46 illustrate a preferred embodiment force coupler 600 designed to couple between a sling such as slings 10, 302 described herein above and in a first configuration to a leg strap, and in a second configuration into a prior art Pouch Attachment Ladder System (PALS) compatible coupler such as may then be used in the Modular Lightweight Load-carrying Equipment (MOLLE) load bearing system to attach securely to a bearer B. Attachment into a PALS/MOLLE system is particularly advantageous since these systems are often a part of standard gear already provided on a soldier, and the body armor supporting the PALS is securely anchored.

An objective of the preferred embodiment force coupler 600 is to reduce the effects of wobble, recoil, and body movement common for soldiers, particularly those in motion, by providing additional support to strap intermediate portion 25 through preferred embodiment force coupler 600 incorporating either a leg strap assembly 616, a known PALS/MOLLE system, or other suitable or equivalent body anchor. The direct benefits are faster shot to shot recover, better accuracy, and better weapon control. While either leg strap 616 as illustrated or a PALS coupler may be omitted, the combination provides for an optimal anchoring system. In some instances, there may be additional body or belt anchors provided and used, depending upon the needs of a particular bearer B. In summary, this preferred embodiment force coupler consists of an extension spring and stabilizer that couple forces from the strap through to the truncal, leg, or other body armor of the user.

Leg anchor strap 602 is securely fastened to leg strap assembly 616 at an anchor strap first end 603. A second tensioning end 604 hangs freely, and is configured to be readily grasped and pulled upon to tension leg anchor strap 602. Since leg anchor strap 602 is ultimately coupled to strap 25, pulling on tension leg anchor strap 602 generates tension in strap 25, and can be used then as one means to control the amount of tension in the strap when rifle 12 is held at a particular position prior to firing.

Optional retainer straps 605 and 606 may preferably removably be coupled together to form a loop using for exemplary and non-limiting purpose a hook and loop fastener 607. These straps 605 and 606 retain second tensioning end 604 in a more controlled position.

To provide a protective cover over the open end of pouch 612, a removable strap closure 610 is provided. In preferred embodiment force coupler 600, removable strap closure 610 is a simple looped strap. Nevertheless, in alternative embodiments removable strap closure 610 may take on other configurations, including but not limited to fully enclosing or covering caps or the like.

Removable strap closure 610 is selectively secured to pouch 612 using for exemplary and non-limiting purpose a hook and loop fastener 611. In those instances where removable strap closure 610 is not desired, it may be slid through a removable loop defined by retainer strap 625 and retainer strap 626, which are secured removably together for exemplary and non-limiting purpose with hook and loop fastener 627.

To enable preferred embodiment force coupler 600 to be coupled onto a belt such as belt 314 or the like, a secondary fastener strap 614 having a looped end 615 is provided to simplify the placement and coupling of the preferred embodiment force coupler 600. Both secondary fastener strap 614 and looped end 615 are provided with a suitable fastening system, again for exemplary and non-limiting purpose with a hook and loop fastener 617. This allows looped end 615 to be passed around the belt, and then affixed back to strap 614 to secure directly to the belt or other equivalent or suitable anchor point.

To enable preferred embodiment force coupler 600 to be coupled into either leg strap assembly 616 or a PALS/MOLLE system, a pair of PALS style loops 619 are preferably provided. These loops 619 provide a passageway for one or more semi-rigid PALS loop engaging members 620 that are visible in FIGS. 41 and 42. Each semi-rigid PALS loop engaging member 620 is preferably comprised by a finger 622 connecting or otherwise anchored at a first end with pouch 612 and terminated at a second end with a rivet 624 that removably engages with pouch 612.

Preferred embodiment force coupler 600 is releasably affixed through a sling clip to sling intermediate portion 25. This is accomplished by providing a slide plate 630 through which leg anchor strap 602 may pass. To facilitate this, a strap slide 634 is provided. In addition, a spring engaging leg 631 and an indentation 632 may help to orient and locate helical spring 618.

Distal to slide plate 630 and also coupled to helical spring 618 is a weapon sling clip coupler 640, also having a strap slide 644, a spring engaging leg 641 and an indentation 642 of similar geometry and function to those like parts of slide plate 630.

Figure 44:
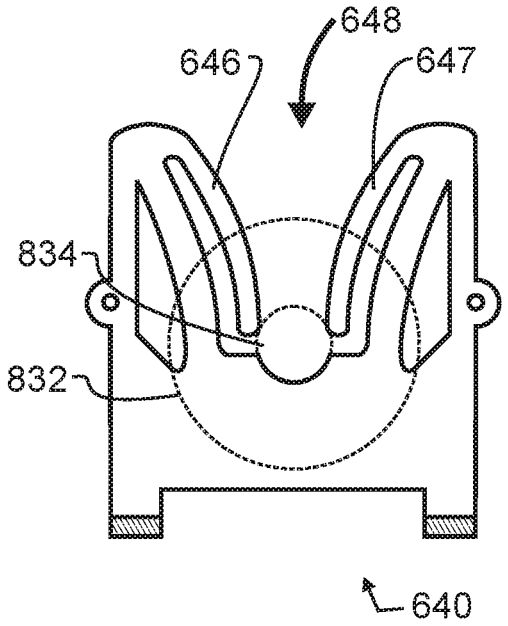
FIG. 44 illustrates the first preferred embodiment weapon sling clip coupler of FIG. 43 from a top view.

FIG. 44 illustrates weapon sling clip coupler 640 from a top view, exposing a pair of cantilevered arms 646, 647 that are separated from each other by the smallest amount adjacent their free ends. This gap 648 defines a slot into which a suitable connector may be inserted, such as engagement coupler 830 described herein below. Owing to the resilience in cantilevered arms 646, 647, shaft 834 may pass more easily into gap 648 than out. This makes the coupling between sling clip 800 and weapon sling clip coupler 640 easy to secure, and relatively more difficult to separate. Further, when firing rifle 12, recoil forces will pull disk 832 tightly up against weapon sling clip coupler 640, further tightening the engagement therebetween.

Figure 41:
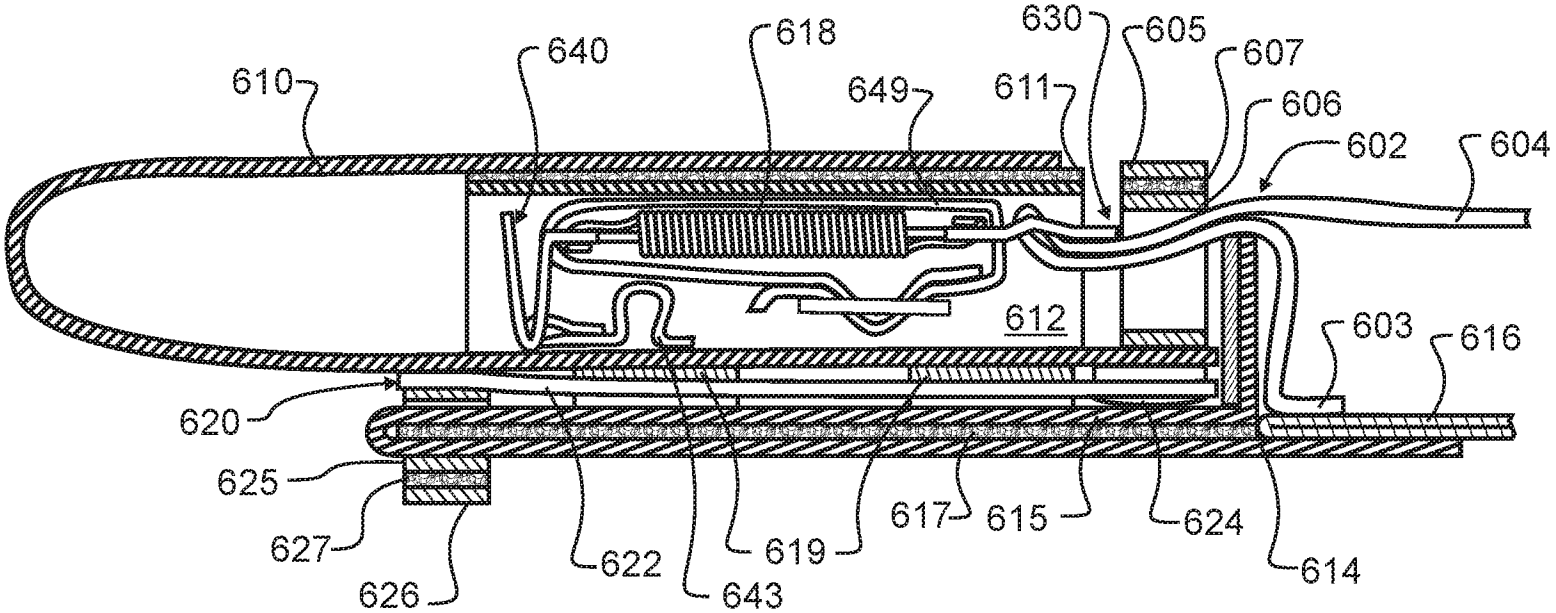
FIG. 41 illustrates the first preferred embodiment force coupler of FIG. 40 from a sectional view taken along section line 41' in FIG. 40.
Figure 42:
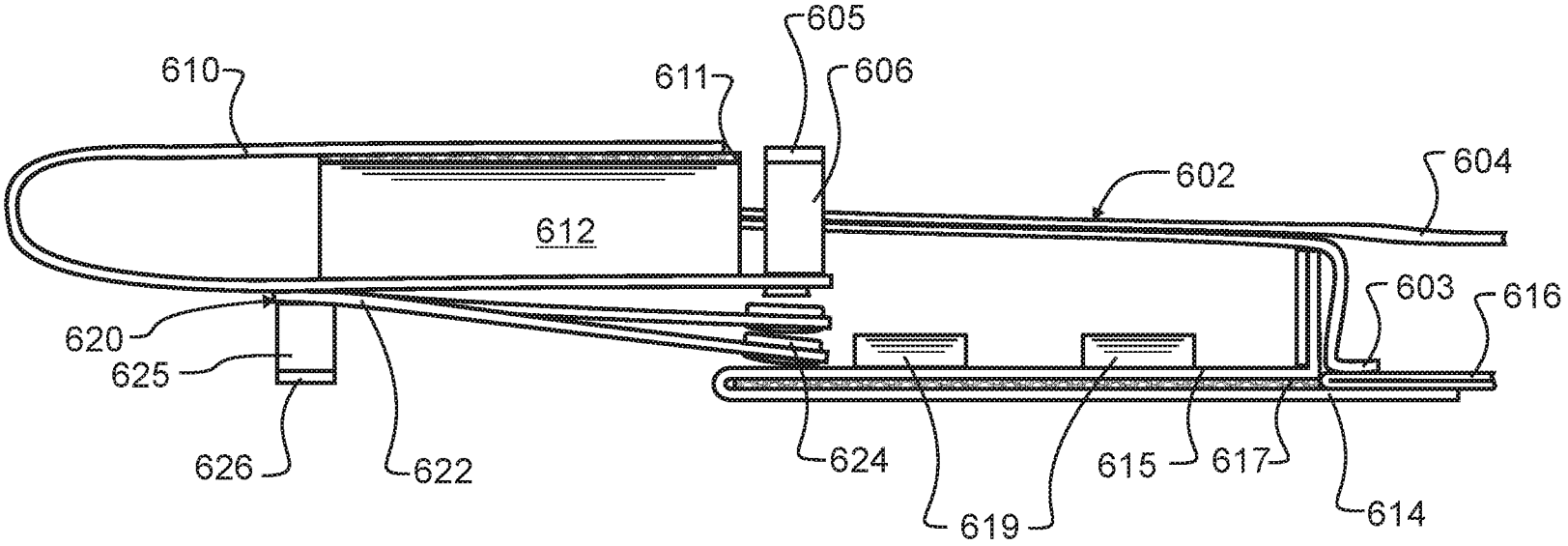
FIG. 42 illustrates the first preferred embodiment force coupler of FIG. 40 from a side view and with the pouch and Pouch Attachment Ladder System (PALS) compatible coupler disconnected a second mating PALS) compatible coupler, such as may then be used in the Modular Lightweight Load-carrying Equipment (MOLLE) load bearing system.

Affixed to strap slide 644 and visible in FIG. 41 is a rotation limiting strap 643. This strap is anchored at a first end to pouch 612, or in alternative embodiments, to strap closure 610. Distal to pouch 612, rotation limiting strap 643 passes through strap slide 644. Rotation limiting strap 643 is configured to limit the amount of rotation of weapon sling clip coupler 640 out of the longitudinal axis of pouch 612 and spring 618 as illustrated in FIG. 41. When a weapons bearer B removes rifle sling 10, 302 from about their body and then lowers rifle 12, it is very desirable that weapon sling clip coupler 640 without effort or with only minimal effort will disconnect from sling clip 800. If rotation limiting strap 643 is configured to limit the amount of rotation of weapon sling clip coupler 640 to approximately ninety degrees in a clockwise direction from the position illustrated in FIG. 41, this will allow the force of gravity on sling clip 800 to help pull shaft 834 out of cantilevered arms 646, 647. If rotation limiting strap 643 is either not provided or is adjusted to be too long, spring 618 may curve sufficiently to allow weapon sling clip coupler 640 to rotate beyond ninety degrees, potentially to a full one-hundred eighty degrees or even more, which will tend to resist separation of sling clip 800 from weapon sling clip coupler 640.

Figure 43:
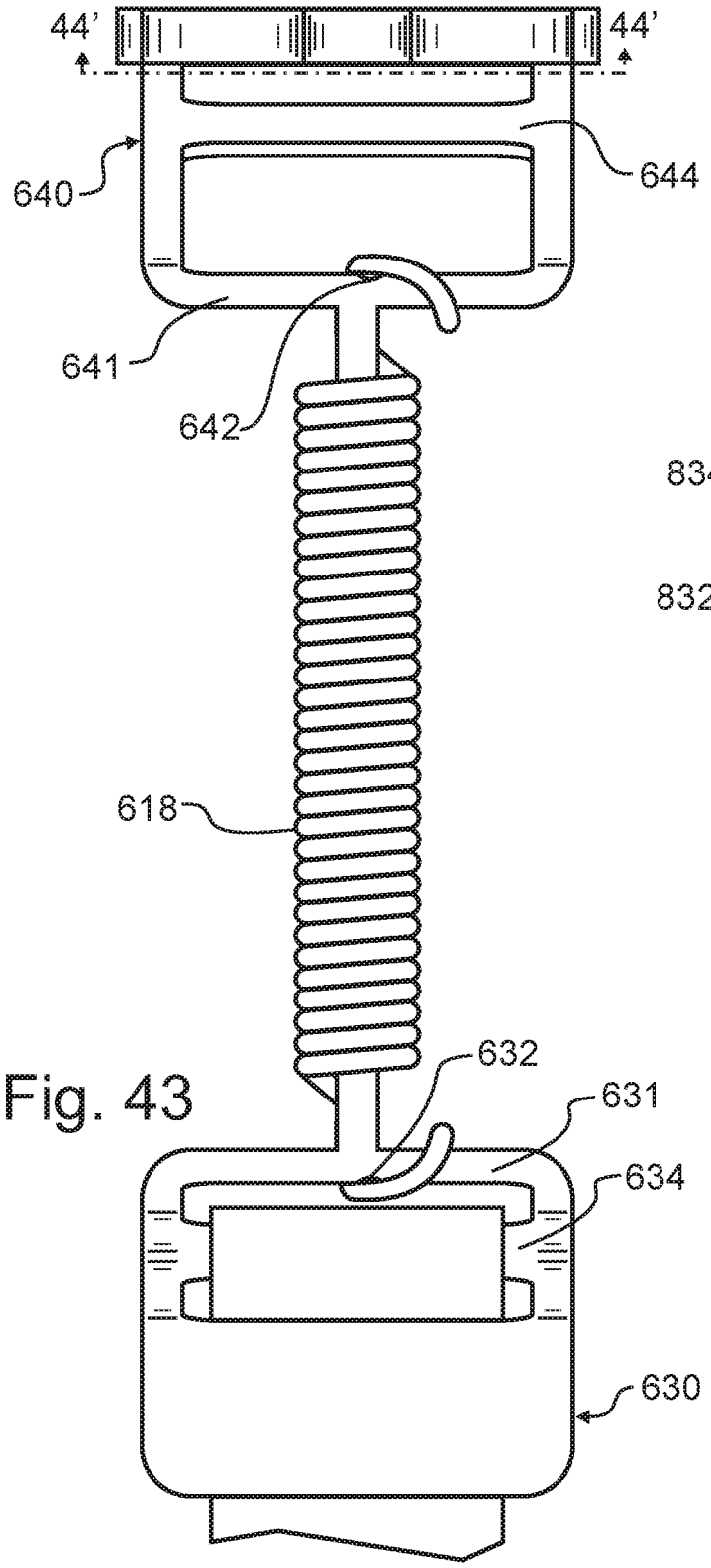
FIG. 43 illustrates only the first preferred embodiment slide plate, spring, and weapon sling clip coupler used in the force coupler of FIG. 40, from a front elevational view similar to that of FIG. 40.

As may be apparent, preferred embodiment weapon sling clip coupler 640 is mounted on top of extension spring 618 best visible in FIG. 43, and will move up and down with bore movement. The pull of sling intermediate portion 25 and resultant tension in spring 618 come into play as soon as the weapon is raised. Subsequent to firing, the strength and stretch of spring 618 will first assist in absorbing energy of the rifle recoil movement. This energy will most preferably be absorbed without pulling the body of bearer B out of shot alignment. Instead, spring 618 stretches, thereby storing some of the recoil energy while working in tandem with the torque of the sling. Next, when recoil is complete, spring 618 will contract and in combination with the sling will pull the rifle bore sights back into the desired point of aim. Because spring 618 and the sling combine to do a part of the work of absorbing and re-applying the forces of recoil, excess force and jerk that are normally required by bearer B are reduced.

The action of spring 618 reduces the settling time required between shots, allowing a bearer B to fire in a semi-automatic mode more quickly. The helical coil spring accomplishes this far better than even an elastic strap, due in part to the efficiency of energy absorption and release, and so is most preferred. Nevertheless, it will be understood that other elastic or resilient members may be substituted, but with somewhat less benefit in most applications.

Since spring 618 is most preferably configured to absorb a portion of the energy of recoil, and then return that energy to pull rifle 12 back into alignment, the spring constant of spring 618 can be adjusted to tune the spring movement to that of the rifle and munitions. In other words, for a low-mass rifle and small munitions load, meaning either or both of a lighter bullet and less powder, a spring 618 having a lower spring constant will allow spring 618 to stretch elastically and return properly. However, a high-mass rifle firing a large munitions load would undesirably stretch the lower spring constant spring through too great a distance, which will potentially drive the bearer B's body out of position and will also delay the return of the rifle to alignment with a target. Instead, for the high-mass rifle and large munitions load, a stronger spring 618, meaning a spring having a greater spring constant, will both reduce the amount of deflection due to recoil and return the rifle to alignment more quickly. As may be appreciated then, for each combination of a bearer B, rifle mass and geometry, and munitions load, the spring constant may be selected to tune the stretch and return.

As is known, automatic rapid firing of a hand-held rifle is very difficult to control with precision. However, with proper tuning of spring 618, the spring will absorb recoil and return just in time for the next firing of the weapon, improving both accuracy and control. The spring and strap resonate at an approximately equal time interval with the timing of sequential firings.

In some instances, spring extension may desirably be limited, or even fully eliminated. This is achieved in the preferred embodiment by shortening the length of extension limiting strap 649 visible in FIG. 41 to less than the length the spring would otherwise extend. Extension limiting strap 649 may be set to different lengths through any suitable provision, but as illustrated in the preferred embodiment by a suitable prior art slide plate. A first fully extended length will render extension limiting strap 649 non-functional, since the strap is longer than required to wrap about a fully extended spring 618. In an intermediate length, extension limiting strap 649 will limit the maximum extension of spring 618. In a fully contracted length, extension limiting strap 649 will prevent spring 618 from extending at all, effectively disabling all function of spring 618.

While not preferred, in alternative embodiments helically wound spring 618 may also be encased in a tube such as a cloth sleeve or slippery plastic tube of polyethylene, polypropylene, or the like to further protect the spring from undesirable entanglement with extraneous debris or matter that might otherwise interfere with proper elastic extension and contraction.

In further alternative embodiments, force coupler 600 may be provided with a pair of springs, rather than single spring 618. A pair of springs allows for more complex movement than that achievable in preferred embodiment force coupler 600 of FIGS. 40-44, but with greater cost and complexity that is generally not merited.

When a weapon such as rifle 12 is shouldered, the sling such as slings 10, 302 described herein above is adjusted to the bearer B's line of sight and point of aim. As already discussed, the length of leg anchor strap 602 may be shortened to in turn pull down on sling clip 800, and thereby also pull down on strap intermediate portion 25. However, this adjustment is by no means the intended primary adjustment mechanism. As noted in the first drawing Figures, a bearer B may assume many different firing positions, each which may also require somewhat different lengths for strap 10, 302 to be most effective.

Figures 45, 46:
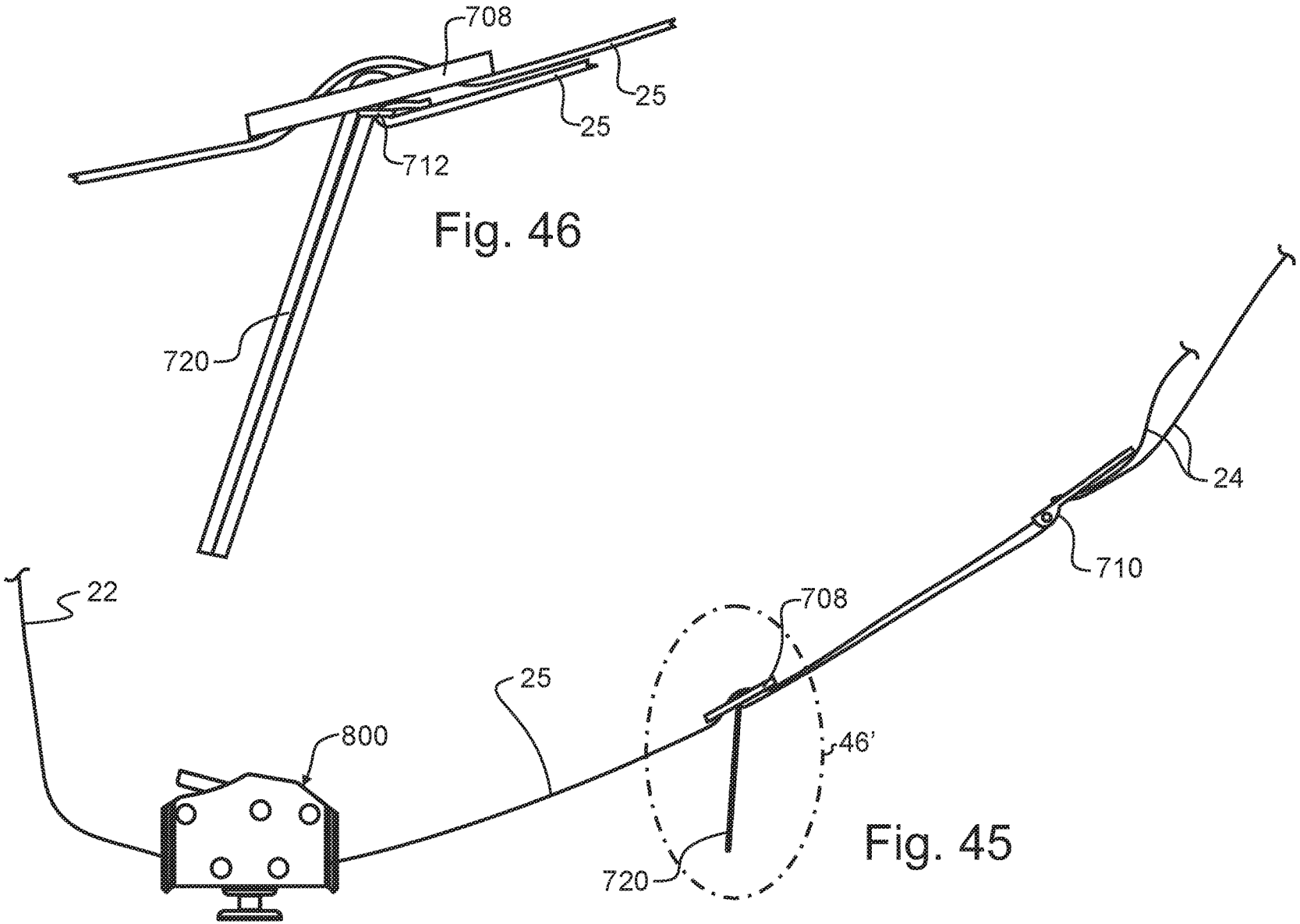
FIG. 45 illustrates a preferred embodiment sling, sling clip, and sling length adjuster in combination from a side elevational view.
FIG. 46 illustrates the preferred embodiment sling and sling length adjuster of FIG. 45 from enlarged view taken along section line 46' in FIG. 45.
Figure 47:
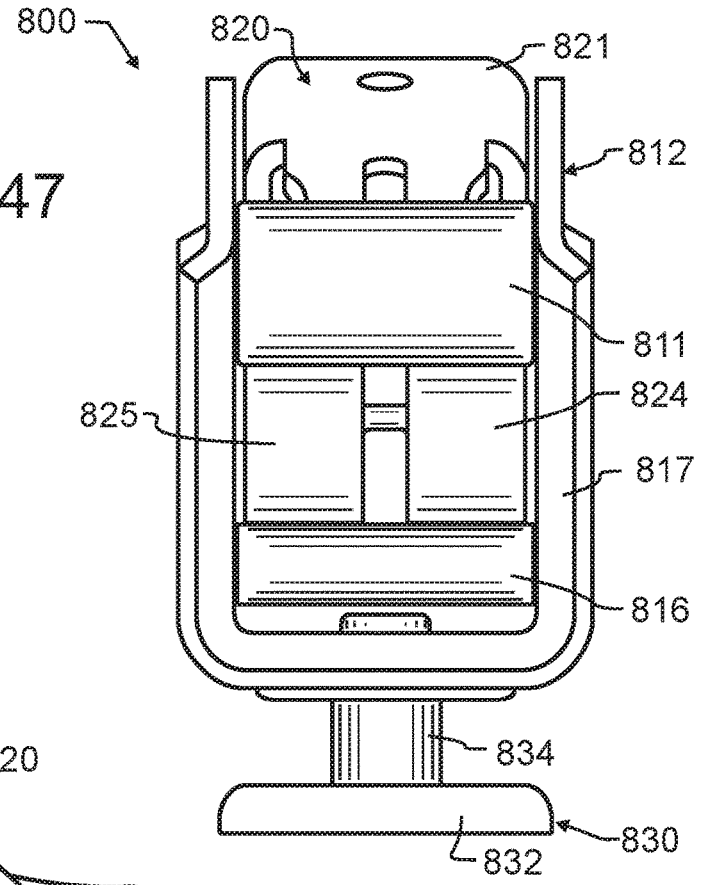
FIGS. 47-50 illustrate another alternative embodiment weapon sling clip with a detachable attachment.
Figure 48:
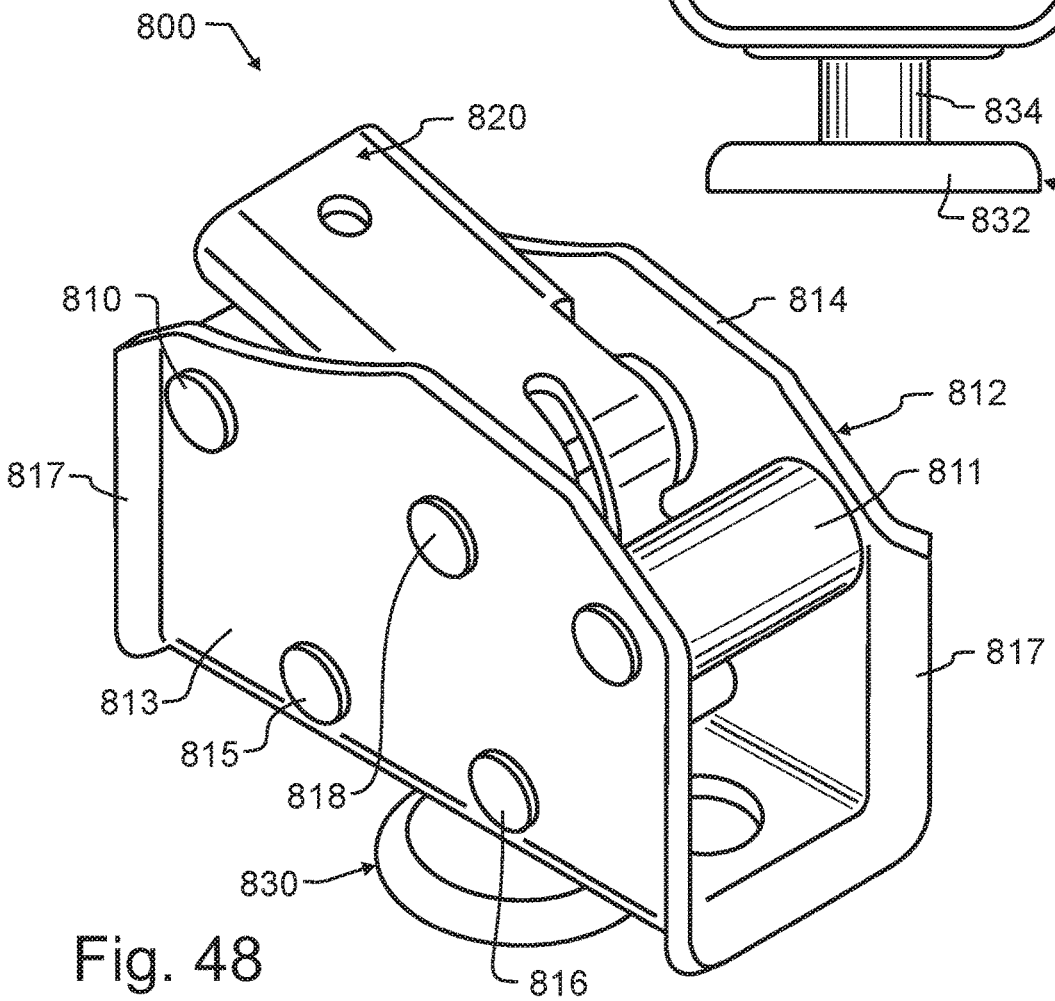

To enable much more rapid adjustment, FIGS. 45 and 46 illustrate a preferred embodiment strap arrangement. Strap intermediate portion 25 is provided with a slide 708 that functions to shorten or lengthen the strap. This is accomplished by a loop that terminates strap intermediate portion 25 on the right side of FIG. 45 at roller 710. As is known in the art of straps, lengthening this loop portion will shorten the overall length of the strap. To provide a particularly intuitive and easy to use apparatus, hand grip 720 has been provided that is simply a semi-rigid strap that is permanently affixed with and extends from the center bridge of slide 708. Strap intermediate portion 25 is secured to and terminates at hand grip 720 through any suitable coupler 712. Strap intermediate portion 25 extends from this termination at hand grip 720 to roller 710, and then returns back to and passes through slide 708. When there is tension on strap intermediate portion 25, the strap runs more parallel to the plane of slide 708, causing the strap to engage with and bite into the edges of the open slits within the slide. This is the normal operation of a slide. Consequently, slide 708 is configured to prevent movement of the strap therethrough, effectively fixing the length of the strap. However, when tension is released, a person may simply grasp and push up on hand grip 720, which redirects strap intermediate portion 25 to run much more perpendicular to the open slits, and thereby greatly reduces the force required for the strap to pass through slide 708. Furthermore, roller 710 also reduces the friction at the turn-around point of strap intermediate portion 25. In combination, slide 708, roller 710, suitable coupler 712, and hand grip 720 allow a person to simply release tension on strap intermediate portion 25, push gently up on hand grip 720, and then shift the position of hand grip 720, and therefore the position of slide 708, along strap intermediate portion 25. Without any significant effort, the person may in a fraction of a second readjust the strap length to accommodate a desired shooting position.

As illustrated in FIG. 2, a common prior art coupling will include a swivel 23 about which is attached a second end portion 24 of sling strap 20. As illustrated in FIG. 45, this portion is still provided. At first impression, this may then seem that roller 710 is merely duplicating the function of swivel 23. However, in order for strap intermediate portion 25 to pass freely through roller 710, it must do so running almost perpendicular to the roller axis of rotation. Otherwise, the strap will bunch to one side or the other of roller 710, and thereby potentially bind. If roller 710 were provided as a direct replacement for swivel 23, such binding would be likely and frustrating. Instead, in the embodiment of FIG. 45, any misalignment will be accommodated between swivel 23 and second end portion 24 of sling strap 20. Consequently, roller 710 and strap intermediate portion 25 will remain properly aligned and optimally functional.

FIGS. 47-50 illustrate another alternative embodiment weapon sling clip 800 with a detachable attachment in the form of engagement coupler 830. While this weapon sling clip 800 resembles that of weapon sling clip 500 illustrated in FIGS. 30-39 and functions similarly thereto, the flared sidewall inlet/outlet 817 and other geometry have been modified to allow the strap to more effectively be doubled over at the point of insertion, improving strap hold while reducing wear on the strap.

Figure 49:
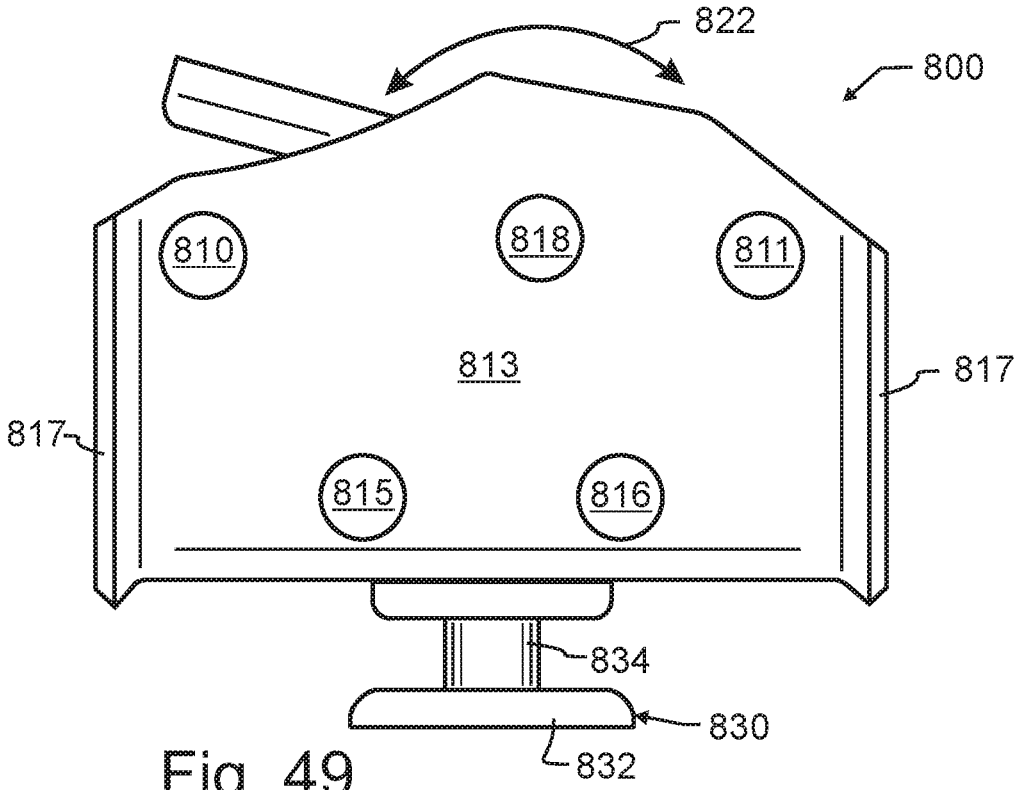
Figure 50:
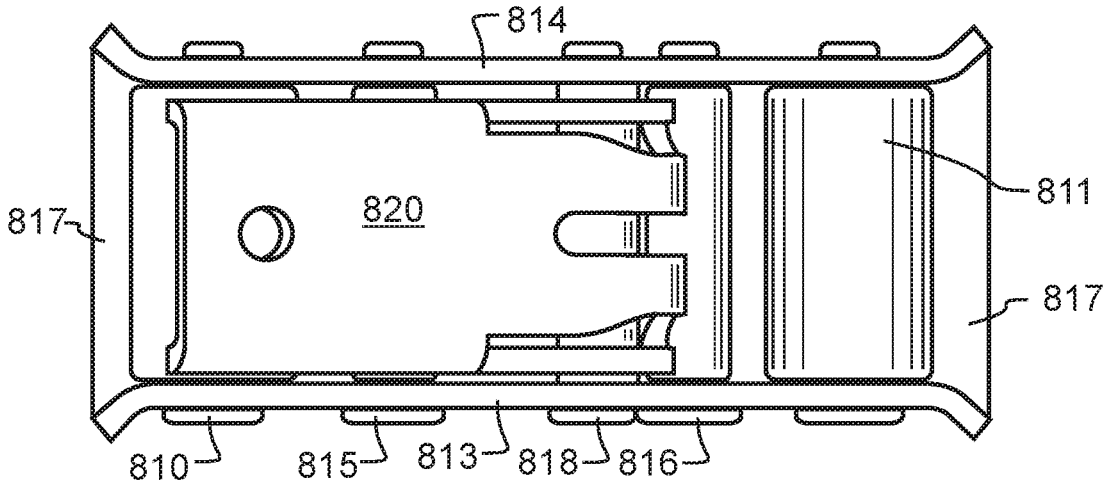

Strap guide 812 defines a body with a pair of sidewalls 813, 814 through which a strap such as strap intermediate portion 25 may pass. Lock cam 820 is provided with a lock cam handle 821 that is configured to be manually pushed in either a clockwise or counterclockwise manner. Pushing lock cam handle 821 will cause lock cam 820 to rotate about lock cam pivot shaft 818 as illustrated in FIG. 49 by pivot direction arrow 822. In one extreme direction of rotation lock cam 820 will be in an open position out of the strap path, allowing the strap to be inserted or to move through the clip without interference from the lock cam. In a second extreme direction of rotation lock cam 820 will be in a closed position approximately as illustrated in FIGS. 47-50, wherein a strap will be captured between lock cam 820 and the adjacent pair of transversely oriented bottom guide rods 815, 816. A pair of optional but preferred strap guide rollers

810, 811 are provided adjacent each flared sidewall inlet/outlet 817 to reduce friction and wear when a strap is shifted relative to sling clip 800.

Lock cam 820 is further provided with a pair of independently deformable cams 824, 825 with a small gap therebetween. This "split" cam geometry ensures better contact with the strap adjacent to both sidewalls 813, 814, even if one side or the other is thicker or more elevated than the other. As a result, the pair of independently deformable cams 824, 825 enhance the effectiveness of lock cam 820 at securing a strap against movement when in the closed position. To further improve the effectiveness of cams 824, 825, the cams may in some embodiments be provided with a knurled surface, coating, or other surface treatment or geometry designed to increase the friction between the cams and a strap.

Most preferably, when lock cam 820 is in this closed and thereby locked position, it will not only press the strap against the adjacent pair of transversely oriented bottom guide rods 815, 816, it will also deflect the strap into the space between bottom guide rods 815, 816 and toward the bottom of strap guide 812. This creates significant frictional engagement of the lock cam through a relatively longer distance and at a greater angle of engagement, and thereby better resists slip during firing of a weapon.

As already described herein above, engagement coupler 830 incorporates a disk 832 and shaft 834 that together engage with cantilevered arms 646, 647 to selectively make a coupling between sling clip 800 and weapon sling clip coupler 640 that is easy to secure, and relatively more difficult to separate.

It is to be understood that even though numerous characteristics and advantages of various embodiments have been set forth in the description, together with details of the structure and function of various embodiments, this disclosure is illustrative only, and changes may be made in detail, especially in matters of structure and arrangement of parts within the principles described herein to the full extent indicated by the broad general meaning of the terms in which the appended claims are expressed. For example, the particular elements may vary depending on the particular application for the sling while maintaining substantially the same functionality without departing from the scope and spirit of the disclosure. Further, the foregoing description of various embodiments implemented in connection with rifles is to be construed by way of illustration rather than limitation. The embodiments disclosed herein may provide certain advantages, such as increased stability, for other types of weapons, such as pistols, shoulder-mounted rocket launchers, such as light anti-tank weapons (LAWs), as well as recreational weapon analogs such as paintball guns and other pneumatically powered projectile devices. Features and design alternatives that would be obvious to one of ordinary skill in the art are considered to be incorporated also.

I claim:

1. A weapon sling adapted to operatively provide additional support for a weapon carried by a weapon bearer, comprising:

a weapon carried by a weapon bearer;

a strap having a first end and a second end, said first strap end secured to said weapon distal to a second strap end securement;

a sling clip engaged with said strap and adapted to operatively permit said weapon bearer to move said weapon from a slung position to a firing position without disconnecting said strap from said sling clip;

a leg strap assembly configured to operatively secure to said weapon bearer;

a weapon sling clip coupler having a spring resiliently securing said sling clip to said leg strap assembly;

a shaft protruding from said sling clip;

a disk terminating said protruding shaft distal to said sling clip and having a diameter greater than said protruding shaft; and a pair of cantilevered arms within said weapon sling clip coupler defining a gap therebetween and configured to receive and retain said protruding shaft and thereby couple said strap through said sling clip and said protruding shaft to said leg strap assembly.

2. The weapon sling of claim 1, further comprising a pouch enclosing said weapon sling clip coupler.

3. The weapon sling of claim 1, further comprising:

Pouch Attachment Ladder System (PALS) compatible loops affixed to said leg strap assembly; and PALS loop engaging members configured to secure said weapon sling clip coupler to at least one of said PALS compatible loops and a PALS/Modular Lightweight Load-carrying Equipment (MOLLE) load bearing system.

4. The weapon sling of claim 1, further comprising:

a secondary fastener strap affixed to said leg strap assembly;

a secondary fastener strap looped end; and a suitable fastening system for securing said secondary fastener strap looped end onto said secondary fastener strap while entrapping a belt therebetween, and thereby configured to couple said weapon sling clip coupler to said belt.

5. The weapon sling of claim 1, further comprising an extension limiting strap configured to limit the extension of said spring.

6. The weapon sling of claim 5, wherein said extension limiting strap is adjustable to selectively change the extension length limit of said spring.

7. The weapon sling of claim 1, wherein said pair of cantilevered arms are separated from each other by the smallest distance adjacent their free ends, and wherein said weapon sling clip coupler further comprises a plate suspending said pair of cantilevered arms, said weapon sling clip coupler configured to capture said protruding shaft between said cantilevered arm free ends and said plate, with said disk adjacent a first major surface of said plate and said sling clip adjacent a second major surface of said plate opposed to said first major surface.

8. A weapon sling adapted to operatively provide additional support for a weapon carried by a weapon bearer, comprising:

a weapon carried by a weapon bearer;

a strap having a first end and a second end, said first strap end secured to said weapon distal to a second strap end securement;

a sling clip engaged with said strap and adapted to operatively permit said weapon bearer to move said weapon from a slung position to a firing position without disconnecting said strap from said sling clip;

a leg strap assembly configured to operatively secure to said weapon bearer;

a weapon sling clip coupler resiliently securing said sling clip to said leg strap assembly;

Pouch Attachment Ladder System (PALS) compatible loops affixed to said leg strap assembly; and PALS loop engaging members configured to secure said weapon sling clip coupler to at least one of said PALS compatible loops and a PALS/Modular Lightweight Load-carrying Equipment (MOLLE) load bearing system.

9. A weapon sling adapted to operatively provide additional support for a weapon carried by a weapon bearer, comprising:

a weapon carried by a weapon bearer;

a strap having a first end and a second end, said first strap end secured to said weapon distal to a second strap end securement;

a sling clip engaged with said strap and adapted to operatively permit said weapon bearer to move said weapon from a slung position to a firing position without disconnecting said strap from said sling clip;

a leg strap assembly configured to operatively secure to said weapon bearer;

a weapon sling clip coupler resiliently securing said sling clip to said leg strap assembly;

a secondary fastener strap affixed to said leg strap assembly;

a secondary fastener strap looped end; and a suitable fastening system for securing said secondary fastener strap looped end onto said secondary fastener strap while entrapping a belt therebetween, and thereby configured to couple said weapon sling clip coupler to said belt.

* * * * *